US006349780B1

(12) United States Patent
Beuershausen

(10) Patent No.: US 6,349,780 B1
(45) Date of Patent: Feb. 26, 2002

(54) DRILL BIT WITH SELECTIVELY-AGGRESSIVE GAGE PADS

(75) Inventor: Christopher C. Beuershausen, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/637,220

(22) Filed: Aug. 11, 2000

(51) Int. Cl.[7] ..... E21B 10/50
(52) U.S. Cl. ..... 175/408; 175/431; 175/415
(58) Field of Search ..... 175/406, 408, 175/415, 385, 339, 343, 391

(56) References Cited

U.S. PATENT DOCUMENTS

| | | | | |
|---|---|---|---|---|
| 3,727,704 A | | 4/1973 | Abplanalp | |
| 4,982,802 A | | 1/1991 | Warren et al. | |
| 5,010,789 A | | 4/1991 | Brett et al. | |
| 5,033,559 A | | 7/1991 | Fischer | |
| 5,033,560 A | | 7/1991 | Sawyer et al. | |
| 5,042,596 A | | 8/1991 | Brett et al. | |
| 5,061,293 A | | 10/1991 | Barr et al. | |
| 5,099,929 A | | 3/1992 | Keith et al. | |
| 5,111,892 A | | 5/1992 | Sinor et al. | |
| 5,131,478 A | | 7/1992 | Brett et al. | |
| 5,163,524 A | | 11/1992 | Newton, Jr. et al. | |
| 5,651,421 A | | 7/1997 | Newton et al. | |
| 5,655,612 A | | 8/1997 | Grimes et al. | |
| 5,663,512 A | | 9/1997 | Schader et al. | |
| 5,967,247 A | * | 10/1999 | Pessier | 175/408 |
| 5,979,578 A | | 11/1999 | Packer | |
| 6,123,160 A | * | 9/2000 | Tibbitts | 175/385 |
| 6,173,797 B1 | * | 1/2001 | Dykstra et al. | 175/374 |
| 6,253,863 B1 | * | 7/2001 | Mensa-Wilmot et al. | 175/408 |

* cited by examiner

*Primary Examiner*—Frank S. Tsay
(74) *Attorney, Agent, or Firm*—TraskBritt

(57) ABSTRACT

A rotary drill bit having a plurality of circumferentially spaced gage pads for drilling bore holes of a preselected trajectory, including lateral or deviated bore holes, in subterranean formations. Each gage pad is provided with, or alternatively associated with, at least one aggressive gage, or side, cutting element having a preselected relative degree of aggressiveness. Selected circumferentially spaced gage pads comprise at least one gage cutting element, or cutting region, disposed thereon and/or comprise alternative gage-cutting elements longitudinally proximate and exclusively associated with a selected gage pad. At least one such gage-cutting element provides more aggressive gage-cutting than at least one other, less aggressive gage-cutting element disposed on, or associated with, a different gage pad. Each of the more aggressive gage pads and each of the less aggressive gage pads may be positioned about the drill bit in a wide variety of circumferential patterns including, but not limited to, an every other alternating gage pad aggressivity pattern. A further optional circumferential gage pad alternation pattern includes, but is not limited to, a first plurality of gage pads having a generally similar first level of aggressiveness being placed proximate and circumferentially adjacent each other on a selected side of the drill bit, with the remaining second plurality of gage pads having a generally similar second level of aggressiveness being placed proximate and circumferentially adjacent each other on the opposite side of the drill bit. Drill bits embodying gage-cutting elements of more than two levels or degrees of aggressivity are also disclosed.

50 Claims, 21 Drawing Sheets

DRILL BIT WITH SELECTIVELY-AGGRESSIVE GAGE PADS

BACKGROUND OF THE INVENTION

1. Field of the Invention

This invention relates generally to rotary drill bits useful for subterranean drilling, or forming boreholes in subterranean formations. More particularly, the invention pertains to rotary drill bits, also referred to as drag bits, having improved directional control and wear resistance.

2. State of the Art

Rotary drill bits for drilling oil, gas, and geothermal wells, and other similar uses typically comprise a solid or composite metal body having a lower cutting face region and an upper shank region for connection to the bottom hole assembly of a drill string formed of conventional jointed tubular members which are then rotated as a single unit by a drilling rig. Alternatively, rotary drill bits may be attached to a bottom hole assembly including a downhole motor assembly which is in turn connected to an essentially continuous tubing, also referred to as coiled, or reeled, tubing wherein the downhole motor assembly rotates the drill bit. Typically, the bit body has one or more internal passages for introducing drilling fluid, or mud, to the cutting face of the drill bit to cool cutters provided on the face of the drill bit and to facilitate formation chip and formation fines removal. The sides of the drill bit typically include a plurality of radially extending gage pads which have an outermost surface which is of substantially constant diameter and generally parallel to the central longitudinal axis of the drill bit. The gage pads generally contact the wall of the bore hole being drilled in order to support and provide guidance of the drill bit as it advances along a desired cutting path, or trajectory.

As known within the art, certain gage pads of the total number of gage pads provided on a given drill bit are selected to be provided with outwardly extending replaceable cutting elements installed on the gage pad allowing the cutting elements to engage the formation being drilled and to assist in providing gage-cutting, or side-cutting, action therealong. One type of cutting element provided on selected gage pads in the past, referred to as inserts, compacts, and cutters, have been known and used for a relatively long time on the lower cutting face for providing the primary cutting action of the bit. These cutting elements are typically manufactured by forming a superabrasive layer, or table, upon a sintered tungsten carbide substrate. As an example, a tungsten carbide substrate having a polycrystalline diamond (PCD) table or cutting face, is sintered onto the substrate under high pressure and temperature, typically about 1450 to about 1600° C. and about 50 to about 70 kilobar pressure to form a polycrystalline diamond compact (PDC) cutting element or PDC cutter. During this process, a metal sintering aid or catalyst such as cobalt may be premixed with the powdered diamond or swept from the substrate into the diamond to form a bonding matrix at the interface between the diamond and substrate.

The above described PDC cutting elements, or cutters, when installed on selected gage pads instead of on the lower portion of the face of the drill bit, are generally referred to as being gage cutters as the cutting element cuts the outermost gage dimension, or diameter, for the particular drill bit in which the cutters are installed. That is the cutters, or more particularly the cutting surfaces thereof, being positioned at the further-most radial distance from the longitudinal centerline of the drill bit, i.e., the outer periphery of the drill bit, will define the final diameter of the bore hole being formed as a result of the drill bit engaging, cutting, and displacing the subterranean formation in the forming of a well bore.

In addition to the above described PDC cutters being provided on selected gage pads, it is also known that other types of cutting elements can be provided on selected gage pads. For example, it is known that broaching of a radially outwardly facing surface of a gage pad can be performed to provide a plurality of longitudinally extending ribs having abrasive particles, such as natural or synthetic diamonds, embedded therein and wherein the ribs protrude radially outwardly from the surface of the gage pad a preselected distance. Furthermore, it is also known that all of the gage pads of a given drill bit can be provided with such raised generally longitudinally extending ribs having abrasive particles embedded therein and which are formed by way of broaching. However, it is important to note that in such cases that all the gage pads of a given drill bit were provided with such raised ribs embedded with abrasives, the gage pads were provided with the same level or degree of aggressiveness. That is, the raised ribs contained the same density of abrasive particles embedded therein. Further, the raised ribs extended radially outwardly from the gage pad essentially the same preselected distance so as to provide each gage pad with a constant, or same, degree of gage-cutting aggressiveness.

Especially during horizontal and directional drilling operations, cutters, or cutting elements, whether located on the face or gage of the drill bit, are repeatedly subjected to very high forces from a variety of directions and are also subjected to relative high temperatures during drilling operations and may fracture, delaminate, and/or spall to an unuseable state in a relative short time. Such degradation of the cutters results in lost drilling time, and further results in expensive rig time being expended on pulling the drill string in order to replace the worn drill bit with a new or previously repaired substitute bit, and then re-running the drill string back into the borehole in order for drilling to be resumed.

Another problem which occurs related to the horizontal drilling of extended reach boreholes, which are usually begun as generally vertical holes but which are eventually curved to follow a horizontal or tilted path, or trajectory, in order to reach a targeted stratum of formation, or pay zone is that, in many cases, the borehole may be curved, or deviated, as much as 90 degrees, or more. Thus, it is often very difficult to place the bit in the desired orientation at a particular depth within a selected formation stratum, or zone, particularly if the stratum is relatively thin. To achieve a such a curved, or radiused, bore hole, the drill bit must be directionally controllable in order to be continuously "aimed" or guided at an angle with respect to the generally vertical portion of the borehole, usually located near the surface. Furthermore, the drill bit must necessarily have a degree of side, or gage, cutting capability to enlarge the borehole diameter slightly beyond the nominal diameter of the gage pads. Thus, the geometry of a drill bit must be such that it may be canted within the borehole, but not so much that it drifts to one side and forms an enlarged or out-of-round bore hole in an uncontrolled fashion or in an undesired direction. Such drifting commonly occurs with drill bits designed for short radius curves and, in some cases, with bits designed to produce medium radius curves. Furthermore, it is important that the quality, or surface smoothness and roundness of the bore hole be maintained within an acceptable range to not only facilitate the introduction and extraction of drill string and various down hole tools, but also for completing the well by the introduction and cementing of production casing within the bore hole.

For the purposes of the present specification, a long radius curve will be defined as one which makes an arc, or curve, approaching, obtaining, or surpassing an angle of approximately 90 degrees (e.g. from vertical to horizontal) and has a radius of curvature exceeding approximately 1000 foot (approximately 305 meters). A medium radius curve will be defined as one which makes an arc, or curve, approaching, obtaining, or surpassing an angle of approximately 90 degrees with an approximate 300–1000 foot (approximately 91–305 meters) radius of curvature. A short radius curve is one which makes an arc, or curve, approaching, obtaining, or surpassing an angle of approximately 90 degrees with a short radius of curvature, i.e. less than approximately 300 feet (approximately 91 meters) and, in extreme cases, as approximately 20 feet (approximately 6 meters). Generally, any acceptable margins of error with respect to reaching target depths are directly proportional to the radius of curvature of the borehole. That is, the smaller a given radius of curvature that a borehole is to have, the associated acceptable margin of error in drilling to a specified depth is corresponding smaller, necessitating that the drill bit not significantly deviate from the pre-determined path, or trajectory, in order to reach the targeted zone, or zones, of interest. FIG. 23 of the drawings provides an illustration of such different radiused bore hole curvatures. For example, and as will be further described herein, a long-radiused curvature is designated as 78, a medium-radiused curvature is designated as 80, and a short-radiused curvature is designated as 82.

In U.S. Pat. No. 5,163,524 of Newton, Jr. et al., a rotary drill bit is shown with a plurality of circumferentially spaced gage pads, some of the gage pads having gage cutters disposed thereon and with some gage pads being completely free of cutters. According to the Newton et al. '524 patent, the gage pads free of cutters are fabricated to be more abrasion resistant than the gage pads having cutters thereon. Furthermore, according to Newton et al., by providing a drill bit having some gage pads free of cutters, upon a bit experiencing laterally imbalanced forces, the gage pads free of cutters which happen to be engaging the formation of earth at the time will impart or pass on such laterally imbalanced forces directly to the formation in accordance with the '524 Newton et al. patent by way of every third gage which is free of gage-cutters and thereby inhibit the walking, or wandering, of the drill bit within the bore hole.

In U.S. Pat. No. 5,651,421 issued to Newton et al., a rotary drill bit is disclosed having a plurality of alternating and circumferentially spaced primary and secondary blades each having cutters thereon. The Newton et al. '421 patent discloses that preferably each primary and secondary blade is provided with a corresponding primary and secondary gage pad which bear on the side wall of the bore hole being drilled. The Newton et. al. '421 patent further provides that the primary gage pads may include bearing and/or abrading elements which are flush with the surface of the gage pad while each secondary gage pad may include gage cutters which project outwardly beyond the surface of the gage pad for removal of the surrounding formation.

However, the need continues to exist for a drill bit having properties which provides, especially when drilling short or medium radius boreholes, a minimum amount of drifting from a preselected trajectory, which minimizes wear of the drill bit, which cuts at an enhanced rate, and which is configurable to an optimum design especially suited to drill, or bore, into particularly targeted formations of earth at a predetermined trajectory to a predetermined depth.

A yet further need exists for a drill bit, especially when drilling short or medium radius boreholes, which can provide a well bore of an acceptable quality. That is, it is desirable that upon a bore hole being drilled, it have a generally constant roundness, or concentricity, and that the surface of the bore hole have an acceptable level of surface smoothness, or in other words, the surface of the bore hole will not be unacceptably rough, have unacceptable irregularities, or have an unduly distorted geometry.

BRIEF SUMMARY OF THE INVENTION

The present invention includes a rotary drill bit for subterranean drilling exhibiting improved directional control and enhanced borehole quality.

The rotary drill bit of the present invention is especially suitable for directional drilling of deviated, horizontal, extended reach, and other directional wellbores, with improved side, or gage, cutting ability to enable turns of shorter radius and yet with improved resistance to drifting away from a desired trajectory.

The rotary drill bit of the present invention further has the ability to enhance the geometrical and surface quality of the bore hole.

The rotary drill bit of the invention which is also readily configurable for enhanced cutting in specific formations.

The invention comprises a drill bit with a selected number of gage pads preferably ranging from about four to ten or more, depending primarily upon the gage diameter of the bit. At least one cutting element, or aggressive surface, is installed on or is proximate to, each of the gage pads. Gage pads with highly aggressive cutting element surfaces, or on-gage pad cutting elements, or alternatively or in addition to, off-gage pad cutting elements, are alternated with gage pads having less aggressive cutting element surfaces, or on-gage pad cutting elements, or alternatively or in addition to, off-gage pad cutting elements arranged in a preselected circumferential pattern. The degrees of aggressiveness of the alternating gage pads, or cutting elements exclusively associated with each gage pad, may be varied widely, and are controlled and influenced by a number of factors, including but not limited to the radial exposure of the cutting elements, cutting element shape, size, back rake and side rake angles, quantity of individual cutting elements, and shape of the cutting surfaces or edges of the cutting elements. The capability of controlled side, or gage, cutting is enhanced with the selection of the number of and relative positioning of the more aggressive gage pads and associated gage cutting elements while the demonstrated wear characteristics of the rotary bit is maintained, or improved, by the provided alternating less aggressive gage pad.

For any formation of earth through which a bore hole is to be drilled, there exists one or more combinations of aggressiveness-affecting factor selections which will provide a minimum overall cost, a minimum amount of non-productive drilling rig time, a maximum drilling rate, maximum bit life, optimal side cutting capability, minimal distortion or deviation from a desired bore hole geometry, and thus providing an over all enhancement of bore hole quality.

Drill bits embodying, and constructed in accordance with the present invention, may be optimally designed or specifically modified for increasing the drilling into particular formations by taking into account at least the above identified factors.

BRIEF DESCRIPTION OF THE SEVERAL VIEWS OF THE DRAWING

The following drawings illustrate various embodiments of the invention, in which various features are exaggerated and thus the drawings are not necessarily drawn to scale, wherein:

FIG. 19 shows how the cutting surfaces of the cutters proximate the gage pad shown have been trimmed so as not to extend aggressively beyond the radially outermost gage-facing surface of the associated gage pad;

FIG. 20A shows how the off-gage pad cutters proximate the gage pad shown are positioned, and have not been trimmed, to radially protrude beyond the radially outermost gage-facing surface of the gage pad in an aggressive manner thereby defining the gage of the depicted bit;

DETAILED DESCRIPTION OF THE INVENTION

Figure 1:
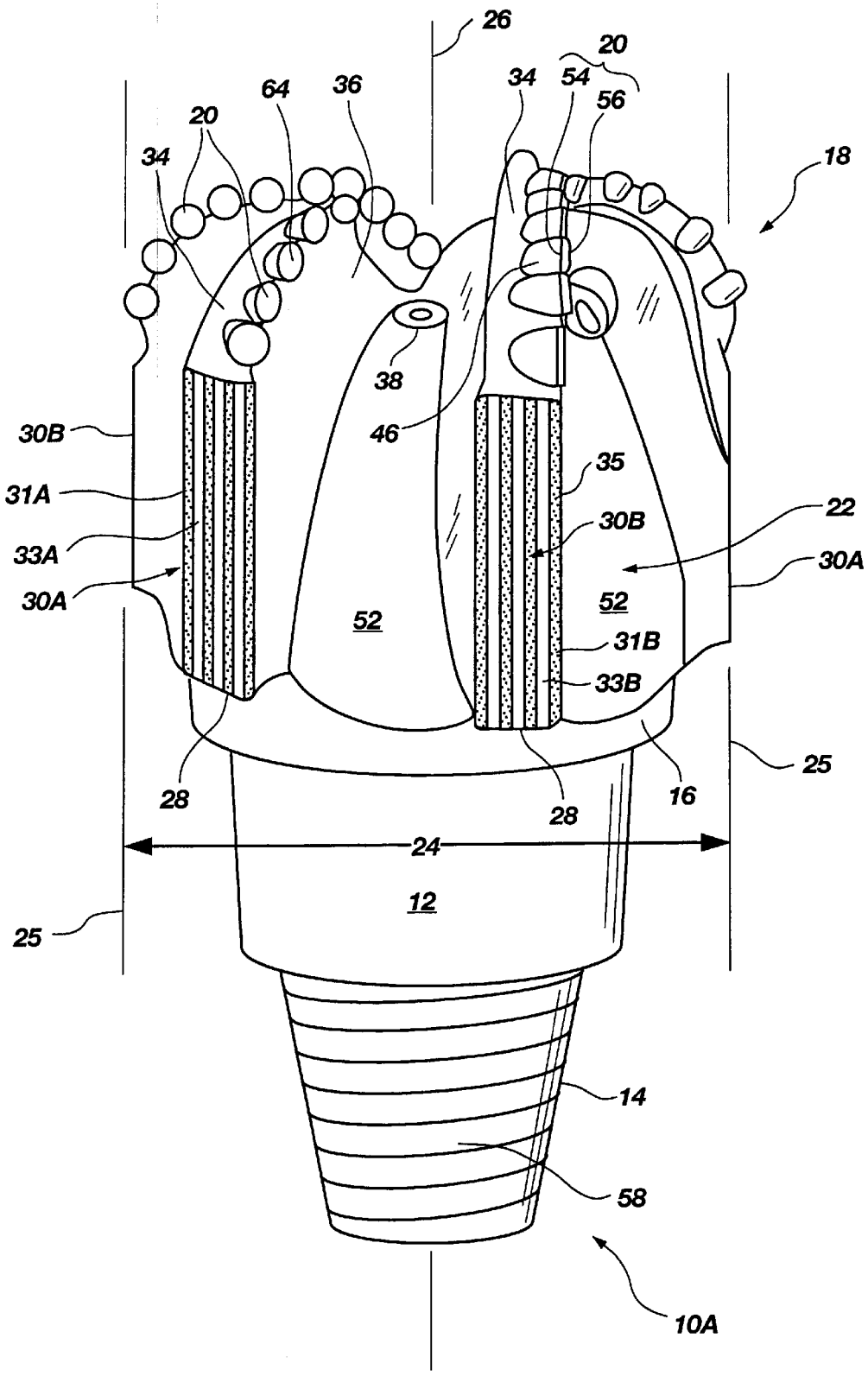
FIG. 1 is a side view of an exemplary drill bit having certain gage pads that have been provided with relatively more aggressive raised ribs embedded with abrasive particles alternating with the remaining gage pads, which have been provided with relatively less aggressive raised ribs embedded with abrasive particles.

The invention comprises a drill bit, or drag bit, with gage pads of an enhanced design to provide improved directional control and increased wear resistance. The drawings illustrate and depict various features which may be selectively incorporated into a drill bit in a variety of combinations in accordance with the present invention.

Embodiments of the present invention are shown in FIGS. 1 through 4, as applied to drill bits 10A and 10B, which are known in the art as being drag (or fixed cutter) bits, useful for drilling a bore hole in a subterranean formation of the earth to reach a targeted formation layer, or zone, for the exploration and/or production of oil and/or gas from such formation layer or for use as a geothermal well or for any other application requiring the creation of a bore hole in the earth. Drill bits 10A and 10B are rotated about central longitudinal axis 26 by a rotary table or a top drive and, where directional drilling, a down-hole motor installed near the end of a drill string (not shown) consisting of for example, continuous tubing or tubular members joined together as known within the art. The downhole motor may be configured and provided as known in the art with the ability to controllably steer drill bits 10A and 10B along a preselected path, or trajectory in which the bore hole is to be positioned. This requires that the actual bore hole diameter be uniformly of slightly greater diameter than the upper portion of bit body 16, leaving space in which drill bits 10A and 10B may be continuously angled or tilted from the axis of the just-drilled bore hole. On the other hand, the bit and drill string must have sufficient directional stability and resistance to wear so that the bit will not drift away from the desired path during the boring operation will follow the desired path of the well bore to the target formation layer, or zone.

As shown in FIGS. 1 through 4, exemplary drill bits 10A and 10B comprise a bit body 16 having a lower face 18 with generally radially-directed downwardly projecting blades 34. Cutting elements 20 may be secured to blades 34 proximate intervening channels 36 for engaging and cutting the formations during rotation of the drill bit as known in the art.

Cutting elements 20 mounted on lower face 18 generally comprising a substrate 54, usually of cemented tungsten carbide, to which a superabrasive layer, or table, 56 is joined are known within the art. Preferably superabrasive table 56 will be a polycrystalline diamond compact (PDC), alternatively a cubic boron nitride compact, and table 56 will preferably have a particular hardness and abrasion resistance particulary suitable for engaging and cutting a variety of subterranean formations. Generally, the superabrasive material which will cut a bore hole in the formations to be encountered with the greatest reliability is selected for use, and in many cases, comprises polycrystalline diamond compact. Cutting table 56 of each cutting element 20 is typically circular about its periphery, and substrate 54, typically comprising or containing tungsten carbide, is mounted in a socket 46 in lower face 18 of bit body 16, although other cutting element types and configurations can be used that are well known in the art.

Bit body 16 may be formed, e.g. machined, of steel or a steel alloy, or molded from an infiltrated particulate tungsten carbide or other matrix material using powdered metallurgy technology known in the art. A central passage is provided longitudinally through bit body 16 for supplying drilling fluid through passages (not shown) to nozzles 38 on lower face 18. The drilling fluid is supplied to lubricate and cool cutting elements 20 and blades 34, and to flush formation chips and cuttings from the cutting elements and the areas in the vicinity of the cutting elements. Drilling fluid passes outwardly from nozzles 38 and through channels 36 and upwardly through junk slots 22, past bit shank 12 and the drill string, not shown, and through the annulus of the bore hole generally away from the drill bit and eventually upward toward the surface. In this particular example, junk slots 22 in bit body 16 are shown as being generally arcuate in transverse cross-section, but their surfaces 52 may alternatively have straight or linear boundaries.

Figure 3:
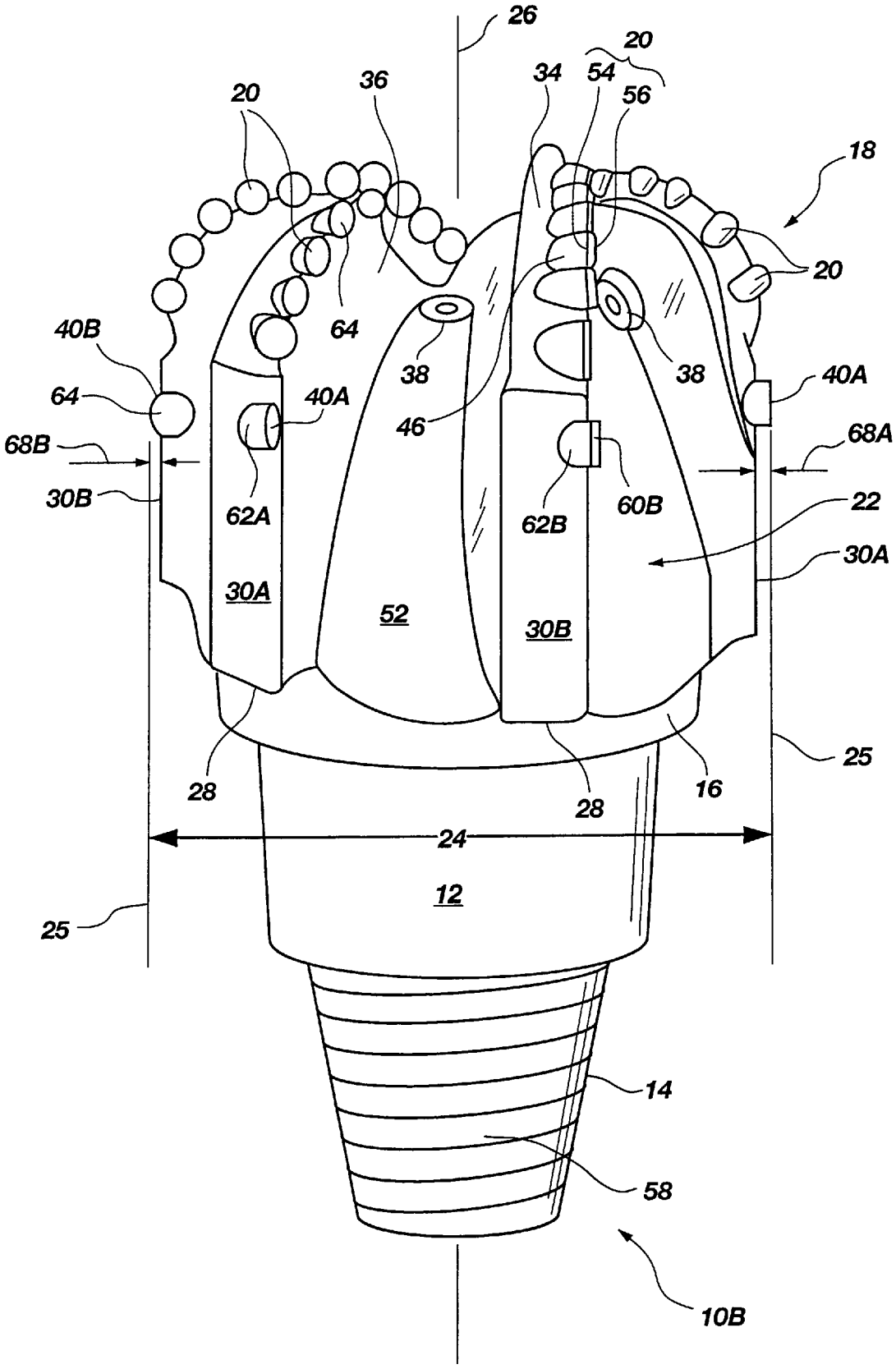
FIG. 3 is a side view of an exemplary drill bit having certain gage pads provided with a very aggressive polycrystalline diamond compact (PDC) cutter mounted thereon alternating with the remaining gage pads having a relatively less aggressive PDC cutter mounted thereon.

Drill bits 10A and 10B include a bit shank 12 having an end 14 for connection to the end of a drill string or alternatively to a down hole drill motor assembly, which are not shown within the drawings. In FIGS. 1 and 3, end 14 is exemplified as a pin end with screw threads 58 but is not limited to such an end connection arrangement.

Figure 2:
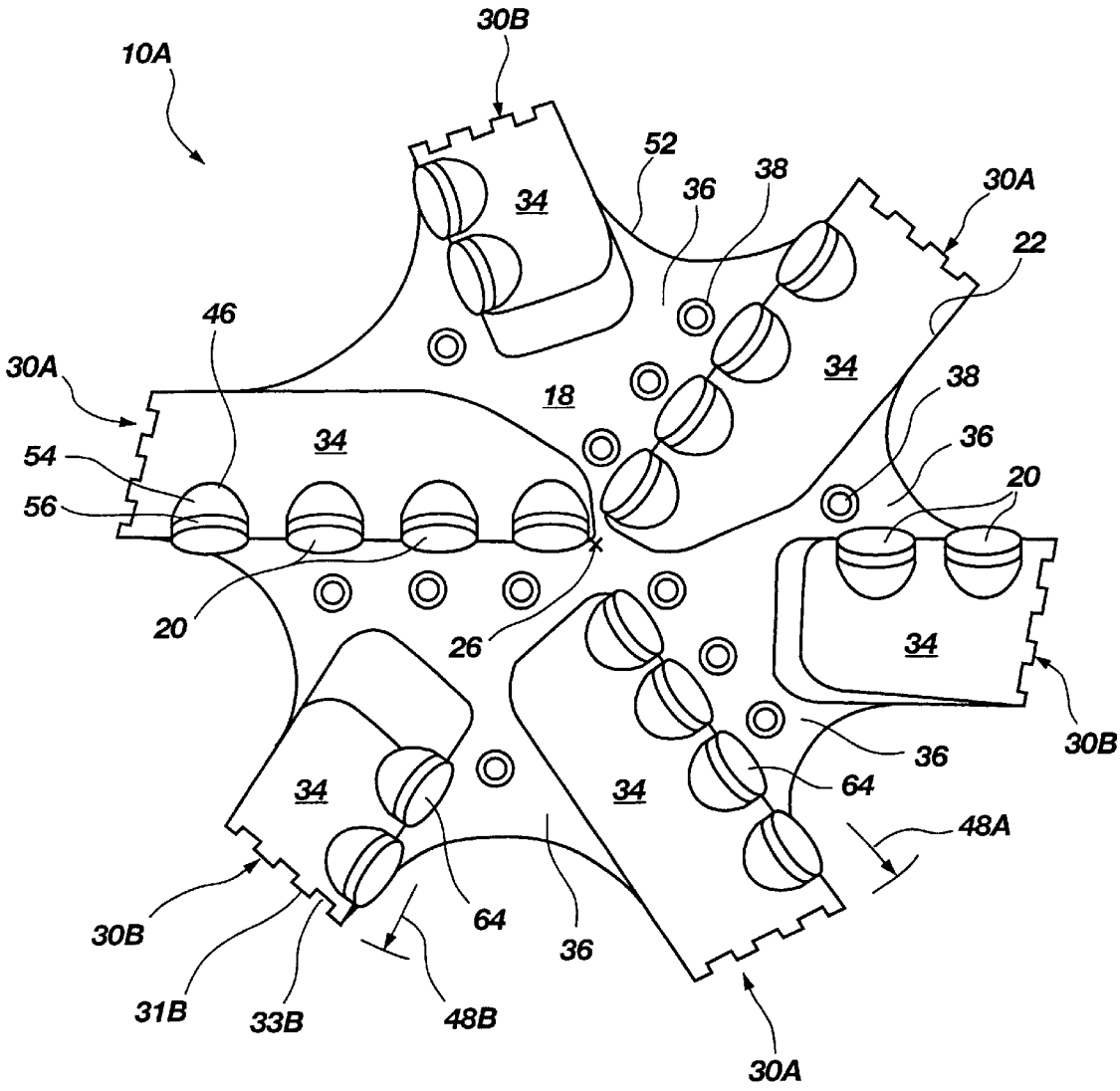
FIG. 2 is a bottom view of the face of an exemplary drill bit such as depicted in FIG. 1.

Referring now to FIGS. 1 and 2. Gage 24 of drill bit 10A is generally defined by the nominal diameter of a plurality of gage pads 30A and 30B. Gage pads 30A and 30B of drill bit 10A are each provided with radially outermost gage-facing surfaces provided with raised portions 31A and 31B. Preferably, raised portions 31A and 31B are formed by broaching but can be formed by machining or various other methods known within the art. Because raised portions 31A and 31B preferably have superabrasive particles 35A and 35B that are embedded to preselected depths therein, raised portions 31A and 31B can broadly be regarded as on-gage pad cutting elements as the raised portions, especially when having superabrasive particles embedded therein and/or when provided with hardfacing material as discussed further herein, aggressively engage and remove formation material when the drill bit is in operation. Superabrasive particles 35 preferably extend slightly outwardly beyond raised portions 31A and 31B, or are exposed, a desired amount and generally terminate at imaginary gage lines 25 which extend generally, but not necessarily exactly, parallel to bit body 16 to help define the maximum diameter, or gage 24, of drill bit 10A. Gage pads 30A, shown to be in an every other alternating pattern with gage pads 30B, are more aggressive relative to gage pads 30B. Conversely, gage pads 30B are less aggressive relative to gage pads 30A. That is raised portions 31A including superabrasive particles 35 embedded and protruding therefrom in each of the designated gage pads 30A provide a cutting element having an overall high degree or magnitude of aggressiveness for engaging and removing material from the earthen formation as drill bit 10A rotates in the process of drilling a bore hole. In contrast, raised portions 31B including superabrasive particles 35 being embedded in raised portions of gage pads 30B protrude to a significantly lesser extent, or only slightly, therefrom in each of the designated gage pads 30B, to provide a cutting element having an overall low degree or magnitude of aggressiveness for engaging and removing material from an earthen formation as drill bit 10B rotates in the process of drilling a bore hole. Superabrasive particles that are particularly suitable for being provided upon gage pads 30A and 30B, include without limitation, natural diamonds of various weights and qualities and thermally stable polycrystalline product (TSP) of various sizes and edge orientations. Furthermore by embedding the superabrasive particles to different depths on raised portions 31A and 31B, the desired disparity between aggressiveness can be further optimized. That is the aggressiveness of a particular raised portion, can be influenced not only by how far radially outward raised portions 31A and 31B extend from their respective gage pads 30A and 30B, but also by how deeply the superabrasive particles themselves are embedded in respective raised portions 31A and 31B. For example, the more embedded a given superabrasive particle is, generally that superabrasive particle will become less aggressive as a smaller portion of the superabrasive particle will be exposed so as to engage the formation in a less aggressive manner. Contrastingly, a less embedded superabrasive particle will have a larger portion of itself exposed thereby tending to be relatively more aggressive in engaging the formation. In addition to selecting the depth, or extent, in which superabrasive particles are embedded to influence the relatively degree of aggressiveness between the cutting element of gage pads 30A and 30B, the degree of aggressiveness between the cutting element provided on pads 30A and 301B, raised portions 31A may further be controlled by providing a higher quantity of superabrasive particles on pads 30A than the quantity of superabrasive particles provided on raised portions 31B. Alternatively, or in addition, raised portions 31A may be provided with larger superabrasive particles than those provided in raised portions 31B, thereby, in effect, being more aggressive as well as possibly being more resistant to abrasion than the superabrasive particles provided within raised portions 31B. This is attributable to the larger superabrasive particles of the more aggressive cutting elements being able to better engage the formation and remove more formation material per revolution of the drill bit than the smaller superabrasive particles provided within the less aggressive cutting elements.

Furthermore and in accordance with the present invention, one or more of raised portions 31A and 31B on a given respective gage pad 30A and 30B, need not have abrasive particles embedded along the entire longitudinal length of each raised portion. For example, abrasive particles could be embedded along less than the full longitudinal extent of one or more raised portions 31A/31B on any given pad 30A/30B provided on a drill bit.

Figure 7A:
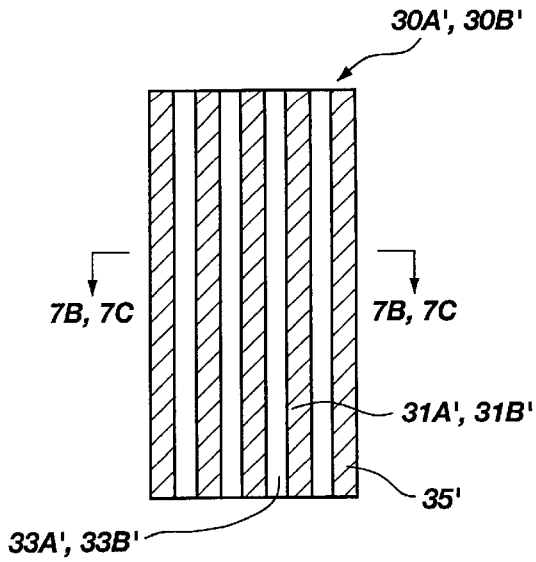
FIG. 7A is an isolated side view of the radially outward-facing surface of an exemplary gage pad provided with a plurality of aggressive longitudinally extending broached ribs having abrasive particles embedded therein.
Figure 7B:
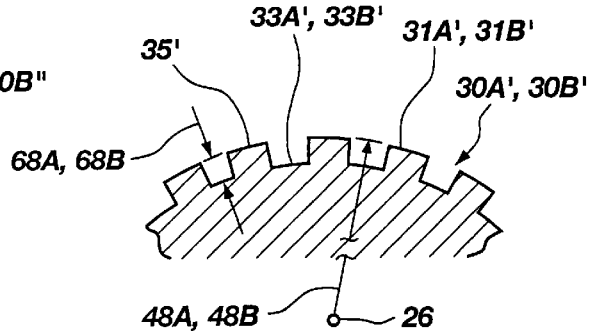
FIG. 7B is a truncated cross-sectional view taken along line 7B—7B of the gage pad shown in FIG. 7A.

Yet further in accordance with the present invention, superabrasive particles, such as natural or synthetic diamond particles, need not be provided in raised portions 31A and/or 31B. Such raised portions, preferably formed by broaching, can alternatively be provided with a hard facing material known in the art. One exemplary hard facing material, or composition, includes the composition set forth in U.S. Pat. No. 5,663,512 issued Sep. 2, 1997 to the assignee of the present invention and which is incorporated herein by this reference. Thus, in lieu of or in combination with providing raised portions 31A and/or 31B with natural or synthetic diamond particles 35, a hard facing composition such as the hard facing composition disclosed in U.S. Pat. No. 5,663,512, regardless of whether the raised portions are formed by broaching or other types of machining processes known in the art, can be provided on raised portions located on the radially outermost gage-facing surfaces of gage pads 34A and 34B. Representative gage pads 30A', 30B' as illustrated in FIGS. 7A and 7B of the drawings have such a hard facing composition disposed thereon. As with the gage pads shown in FIGS. 1 and 2, representative gage pad 30A'/30B' of FIG. 7A, and as shown in cross-section in 7B, are each provided with raised portions 31A',31B' and respective recesses 33A', 33B'. Thus, a gage pad provided with at least one cutting element incorporating hard facing material 35' provides a suitably aggressive cutting element, particulary when appropriately combined with raised portions such as raised portions 31A' and/or 31B'.

As an alternative to the raised portions or ribs described above and as depicted in FIGS. 1, 2, 7A, and 7B for example, the vertical, mutually parallel orientation of raised portions 31A, 31A', 31B, and/or 31B' can be oriented to be slanted, or angled across its respective gage pad, or can be oriented to be convergent, divergent, or cris-crossed with respect to other raised portions in lieu of being parallel as shown and thus are not to be limited to the vertical, mutually parallel arrangement as provided on exemplary drill bit 10 as shown in FIGS. 1 and 2 of the drawings.

In general, both the absolute and relative degree of aggressiveness of gage pads 30A and 30B provided on drill bit 10 are defined by the quantity of material engaged and cut from the formation of the earth per revolution of drill bit 10. With respect to drill bit 10A having raised portions, such as the longitudinally extending rib like portions illustrated in FIGS. 1, 2, and 7A and 7B or the above mentioned alternatives thereto, the type, size, and quantity of superabrasive particles embedded therein, and the relative aggressiveness of gage pads 30A, 30B are also controlled and influenced by a number of additional factors, including but not necessarily limited by: the extent, or degree, of exposure of raised portions 31A, 31B, i.e. the extension distance 48A, 48B radially outwardly from the central longitudinal axis 26, including superabrasive particles or abrasive particles, or material, at least partially embedded and protruding slightly or even considerably from raised portion 31A, 31B or otherwise disposed on at least the raised portions; shape of the furthermost cutting surfaces located on the gage pad; the overall greater quantity, width, and length of raised portions provided on the more aggressive gage pads 30A compared to the overall lesser quantity, width, and length of raised portions on each lower aggressivity gage pads 30B; and the relative quantity, size or weight, and degree of abrasiveness, or cutting ability, of the superabrasive or abrasive particles or material provided on gage pads 30A, 30B.

Figure 4:
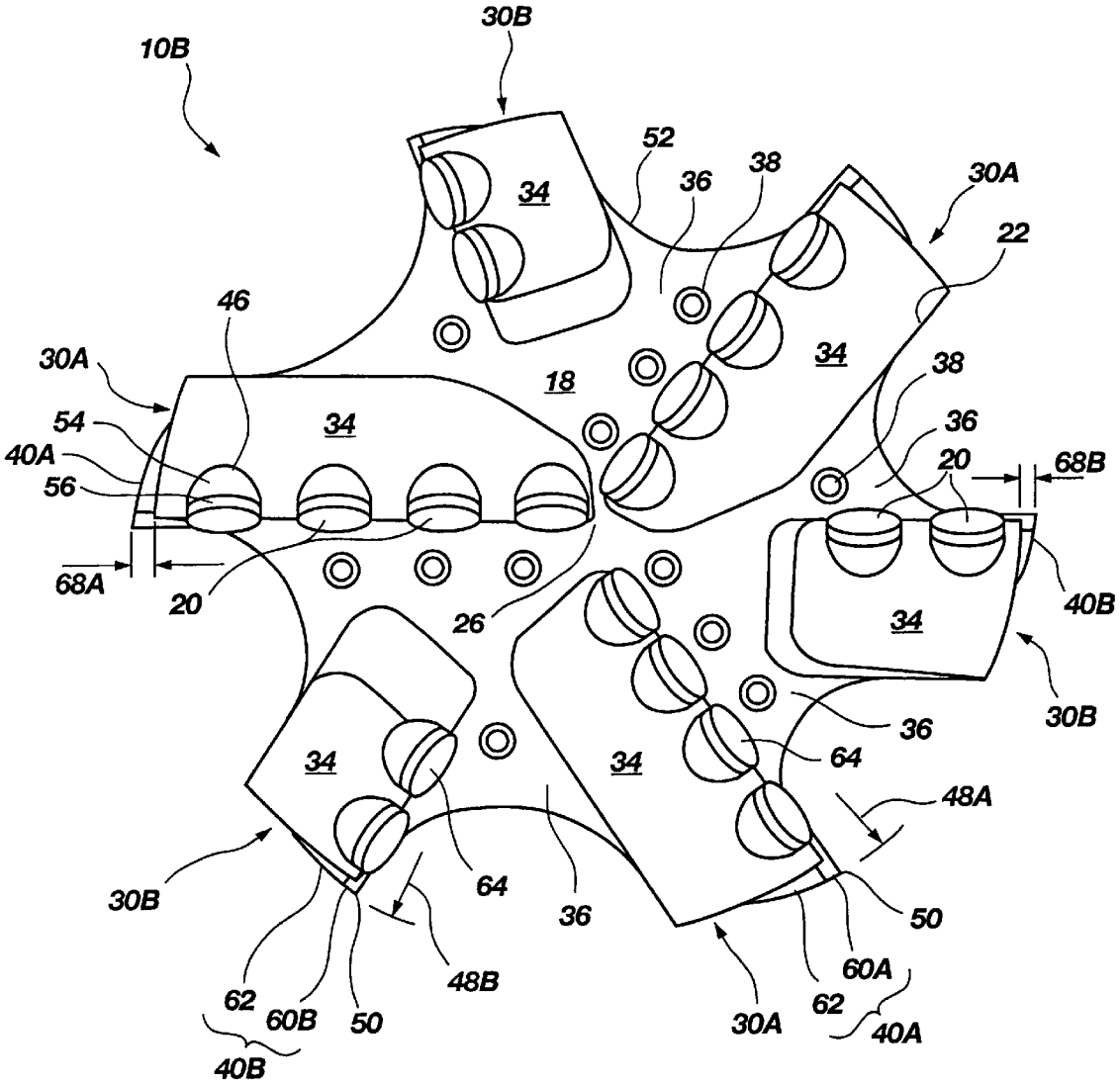
FIG. 4 is a bottom view of the face of an exemplary drill bit such as depicted in FIG. 3.

Reference now being made to FIGS. 3 and 4 of the drawings. In this particular embodiment of the present invention, gage 24 of drill bit 10B is defined by the nominal diameter of a plurality of circumferentially spaced gage pad cutters 40 mounted directly on gage pads 30A and 30B, previously designated as higher aggressivity gage pads and lower aggressivity gage pads, respectively. Such As previously described and shown, the inter-pad spaces comprise junk slots 22 and each gage pad 30A, 30B is generally oriented parallel to longitudinal axis 26 of drill bit 10. In these figures, radial extensions 28 are shown as being continuous with cutting face blades 34, although other embodiments may have gage pads 30A, 30B non-connected and non-aligned with blades 34.

Drill bits 10A, 10B as well as gage pads 30A, 30B may be formed from the same material as the remainder of bit body 16, such as a steel, a steel or iron alloy, or matrix material, as previously referenced. Optionally, to prevent unacceptable wear, gage pads 30A, 30B may be formed with a smooth, hard facing of any of the various compositions, or materials, known to be suitable, each having a particular degree of abrasion resistance. A yet further option is that gage pads 30A and 30B may be partially or completely covered with superabrasive material such as diamond grit, polycrystalline diamond compact (PDC) formed into bricks or infiltrated as particles into the radially outermost gage-facing surfaces of gage pads 30A, 30B which will be further described and illustrated herein and is not limited to the illustrated embodiments of drill bit 10A of FIGS. 1 and 2 and drill bit 10B of FIGS. 3 and 4. Furthermore, more aggressive gage pads 30A may be provided with a radially outermost gage-facing surface having not only aggressive cutting elements comprising superabrasive particles or abrasive particles or hard facing material, but may be formed of, or provided with, a more impact-resistant material than the radially outermost gage-facing surface of lower aggressivity gage pads 30B.

In accordance with the embodiment of the present invention shown in FIGS. 3 and 4, at least one gage pad cutter 40A, 40B is mounted directly on each gage pad 30A, 30B and thus can be regarded as on-gage pad cutters. As with drill bit 10A shown in FIGS. 1 and 2, drill bit 10B is provided with alternating gage pads configured to have differing aggressiveness with respect to side, or gage, cutting capability as previously described. Thus, drill bit 10B is depicted as having higher aggressivity gage pads 30A arranged in an alternating fashion with lower aggressivity gage pads 30B. The number of higher aggressivity pads 30A may be equal to the number of lower aggressivity pads 30B so that if desired the outer periphery of the bit 10 is symmetrically balanced for drilling bore holes with a minimum amount of wandering from the desired trajectory, to further minimize the amount of wellbore distortion or out-of-roundness and wellbore irregularities, as well as to minimize out-of-gage fluctuations of the inner diameter of the bore hole. In other words, a drill bit incorporating the present invention could employ an equal number of higher aggressivity gage pads 30A and lower aggressivity gage pads 30B in order that the bit would be radially symmetrical and thus would engage and cut the formation to produce a wellbore of a preselected size, geometry, and quality. However, as will be discussed further herein, gage pads 30A and 30B can be provided in other alternation patterns in lieu of or in addition to the symmetrical every-other alternation pattern shown in FIGS. 1–4.

In general, and as discussed with respect to drill bit 10A above, the overall aggressiveness of gage pads 30A and 30B, is defined by the quantity of formation material engaged and cut from the formation of the earth per rotation of drill bit 10. In regards to drill bit 10B having conventional cutters mounted on gage pads 30A and 30B, such aggressiveness is controlled and influenced by a number of factors, including but not necessarily limited by: the degree of exposure of gage pad cutters 40A and 40B, i.e. the extension distance 48A, 48B radially outwardly from the central longitudinal axis 26 and/or the distance 68A from the radially outermost gage-facing surface of gage pads 30A and 30B; shape of the gage pad cutting elements, or cutters, 40, e.g. rounded, or truncated, or circular, etc.; and size (e.g., diameter) of gage pad cutters 40; number of gage pad cutters 40A on each of the more aggressive gage pads 30A and the number of gage pad cutters 40B on each of the less aggressive gage pads 30B. For example, gage pad 30A could have two or more gage pad cutters 40A mounted thereon would be more aggressive than a gage pad 30B having a single gage pad cutter 40B mounted thereon. Sharpness of cutting edges 50 of the gage pad cutters 40A, 40B, i.e. sharp edges vs. chamfered or rounded edges; and the back rake angle of each gage pad cutter 40A, 40B, i.e. the angle at which cutter surface 64 engages formation 72 to be cut also greatly influence, and can be selected to provide the degree of aggressivity desired for each gage pad 30A and 30B. Furthermore, due to the large variety of cutting surfaces, or individual cutting elements that can be employed in accordance with the present invention the term "cutting element" as used herein not only refers to individual cutting elements such as an individual PCD cutter, a TCI button, etc. but also is used to refer to a particular region containing, or otherwise having disposed thereon and/or therein, superabrasive particles, or abrasive particles or abrasive surface coatings or treatments, to provide a "cutting element" for engaging and cutting earthen formations at a preselected level of aggressivity. It should also be understood, that in practicing the present invention, it may be desirable for a given on-gage pad cutting element to be essentially flush to the radially outermost gage-facing surface of a given gage pad. For example, radial distance 68A,68B, for at least some cutting elements may essentially be zero.

Figure 5:
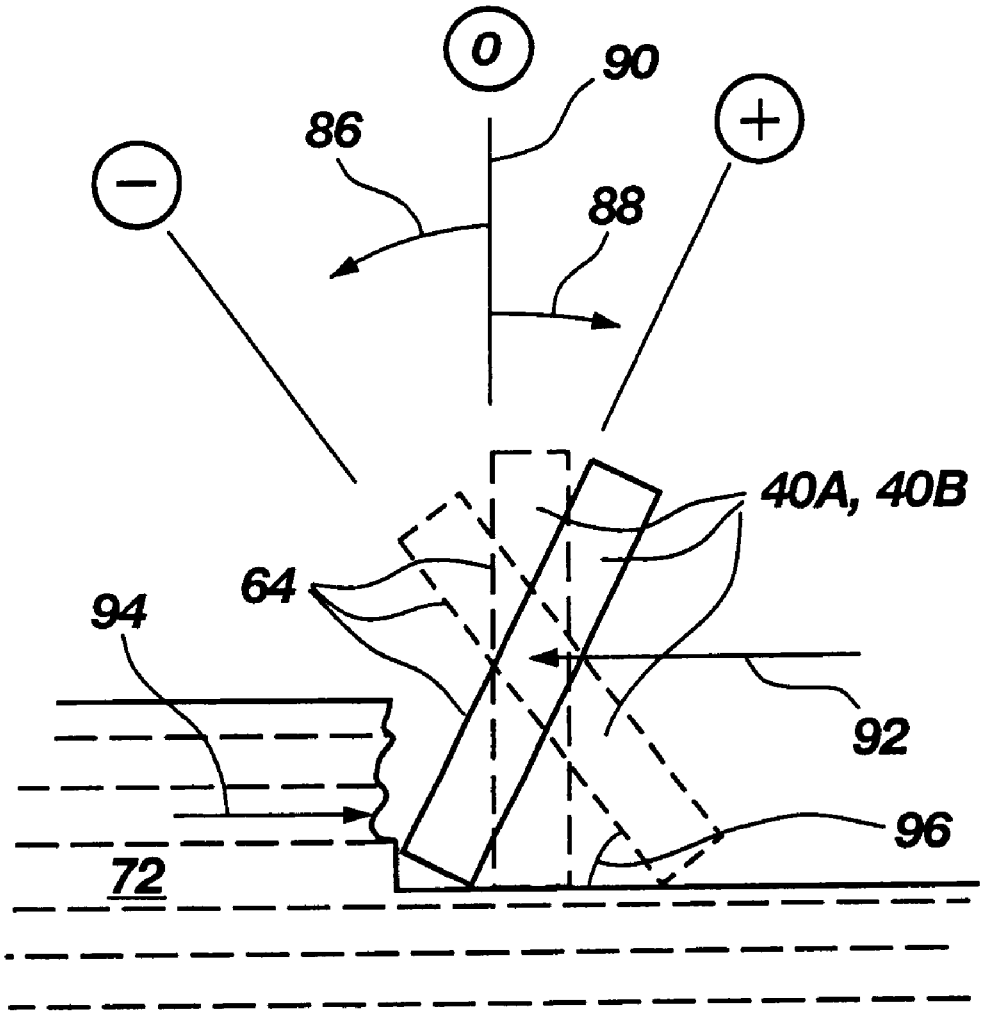
FIG. 5 is a cross-sectional side view of a very aggressive PDC gage cutter of a drill bit according to the present invention, including but not limited to the drill bit shown in FIGS. 3 and 4, illustrating optional rake angles in which the aggressiveness of a PDC type cutter may be altered with respect to how it is positioned to engage a formation.

As shown in FIG. 5, back rake angle of a gage cutter 40 may comprise a zero rake angle 90, a positive rake angle 88 or a negative rake angle 86. In the present invention, gage pad, or side cutters 40A, 40B are preferably positioned at an angle of between about zero rake 90 and a negative rake 86. For many applications, a negative rake of 30 degrees is very effective in a variety of formations 72. As shown in FIG. 5, cutting surface 64 of a cutter 40A, 40B having a negative rake angle 86 and moving in direction 92 is impacted by forces 94 at an angle of incidence 96 which is equal to 90 degrees plus the amount of cutter rake. In this particular example, the actual angle of incidence 96 is about 53 degrees. The aggressiveness of cutter 40 is at least partially a function of angle of incidence 96, being generally regarded as at a maximum when rake angle 90 is zero degrees and regarded as at a minimum when negative rake angle 86 of minus 90 degrees, presuming a positive rake angle 88 is not employed.

The superabrasive cutting material of cutting tables 60A and 60B of side cutters 40A and 40B, may comprise natural diamonds, synthetic diamonds, thermally stable PCD (TSP), or cubic boron nitride (CBN). Each table 60A and 60B may be attached to a substrate 62 formed, for example, of cemented tungsten carbide, although natural diamonds, synthetic diamonds, and TSP's may be cast into and thus embedded in the gage pads during bit fabrication.

Additionally, cutter side rake may also be altered to render a cutter more aggressive, or less aggressive.

The various factors set forth above may be used in various combinations in order to achieve the benefits of the present invention with respect to the embodiment of drill bit 10B. As depicted in FIGS. 3 and 4, the radius 48A at which on-gage pad cutter 40A is positioned may be greater than the radius 48B at which on-gage pad cutter 40B is positioned, thus making cutter 40A more aggressive than cutter 40B. An alternative way to determine and select relative aggressiveness is to determine the distance 68 in which the most distant portion of a given cutter extends from the radially outermost gage-facing surface of the gage pad in which it is mounted or associated with. This alternative way of determining the relative aggressiveness a given cutter, or cutting element is to have, is illustrated within FIGS. 3 and 4 wherein radial distance 68A of cutter 40A extending from representative gage pad 30A is greater than radial distance 68B of cutter 40B extending from representative gage pad 30B.

Cutters 40A and 40B of FIGS. 3 and 4, are all shown with truncated circular cutting tables 60A and 60B, respectively. The table shape may be varied, e.g. fully circular. Furthermore, the exposure of the respective surfaces of cutting tables 60A and 60B to the formation being drilled may be considered a measure of aggressiveness, and such is determined by table size, shape and rake angle of the impinging table surface with the material being drilled.

Generally FIGS. 6A through 14B illustrate a variety of exemplary radially outermost gage-facing gage pad surfaces 30A", 30B" provided with a variety of cutting elements ranging from high degrees of aggressivity to low degrees of aggressivity which can be used in accordance of the present invention. Extension distance 48A,48B from central longitudinal axis 26 of a drill bit to radially further most edge of the various cutting elements depicted is also shown in the cross-sectional views of the various exemplary gage pad surfaces shown.

Figure 6A:
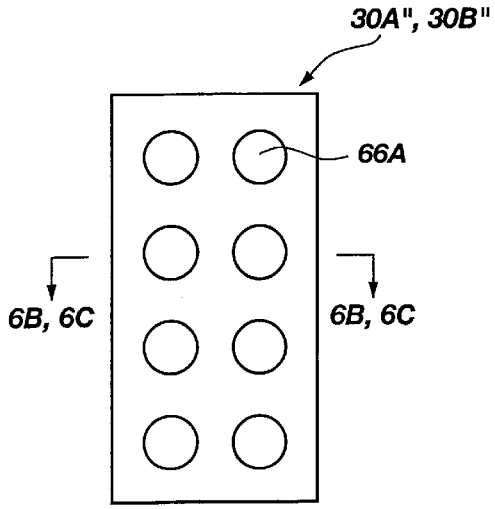
FIG. 6A is an isolated side view of the radially outward-facing surface of an exemplary gage pad provided with a plurality of relatively less aggressive tungsten carbide cutting elements or inserts (TCIs) also referred to as TCI compacts in accordance with the present invention.
Figure 6B:
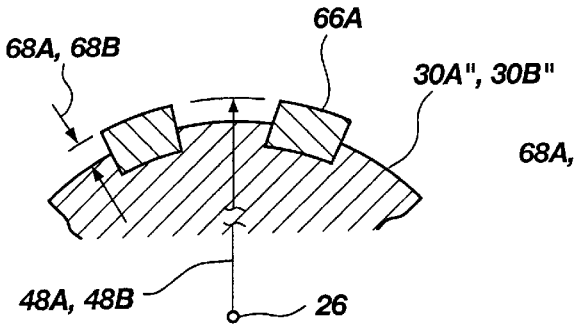
FIG. 6B is a truncated cross-sectional view taken along line 6B—6B of the gage pad shown in FIG. 6A.

More particularly, FIGS. 6A and 6B depict a plurality of cylindrically-shaped tungsten carbide inserts 66A (TCI compacts) preferably being at least partially embedded within the radially outermost gage-facing surface of gage pad 30A", 30B" and extending outwardly therefrom a preselected radial distance designated as distance 68A, 68B. TCIs 66A as depicted, are shown to be embedded generally perpendicular to the surface of gage pad 30A", 30B". However, the quantity and size of the TCI compacts can be provided at various backrakes and siderakes, as previously discussed with respect to side cutters 40A, 40B to provide the desired degree of aggressivity that each gage pad 30A", 30B" is to have.

FIGS. 7A and 7B depicting raised portions, or longitudinal ribs, 31A, 31B' extending a preselected radial distance 68A, 68B from an exemplary alternative gage pad 30A',30B' and provided with a hard facing material 35 as discussed previously.

Figure 8A:
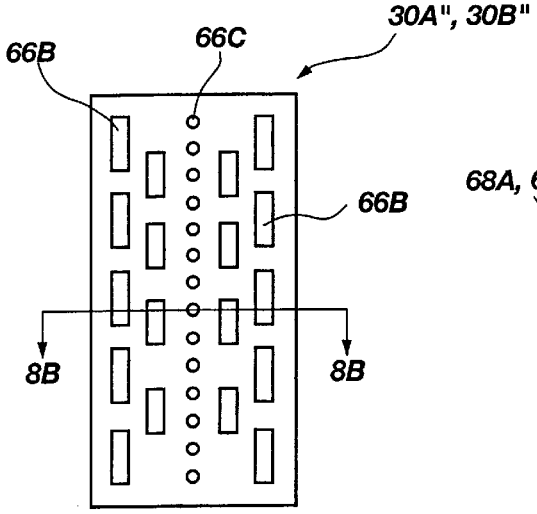
FIG. 8A is an isolated side view of the radially outermost gage-facing surface of an exemplary gage pad provided with a combination of aggressive brick-shaped tungsten carbide cutting elements and aggressive natural diamonds partially embedded therein.
Figure 8B:
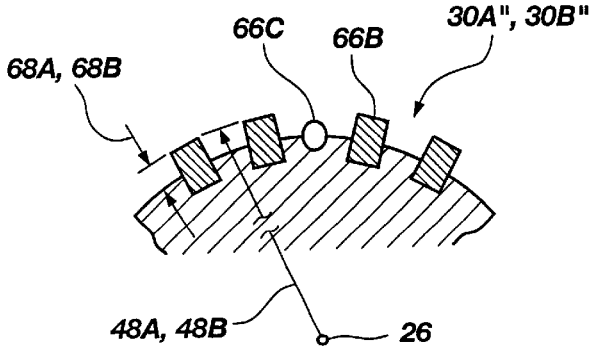
FIG. 8B is a truncated cross-sectional view taken along line 8B—8B of the gage pad shown in FIG. 8A.

FIGS. 8A and 8B depict an exemplary alternative gage pad 30A",30B" having a matrix or pattern of differing cutting elements preferably partially embedded therein and protruding therefrom a preselected radial distance 68A,68B. The respective cutting elements include columns of rectangularly-shaped tungsten carbide inserts 66B, or "bricks" (TCI compacts) and a column of natural diamond particles, or chips 66C. As will now be apparent, a wide variety of matrices or patterns can be constructed having a number of different columns or rows of cutting elements to provide each gage pad with at least one cutting element having a suitable degree of aggressiveness.

Figure 9A:
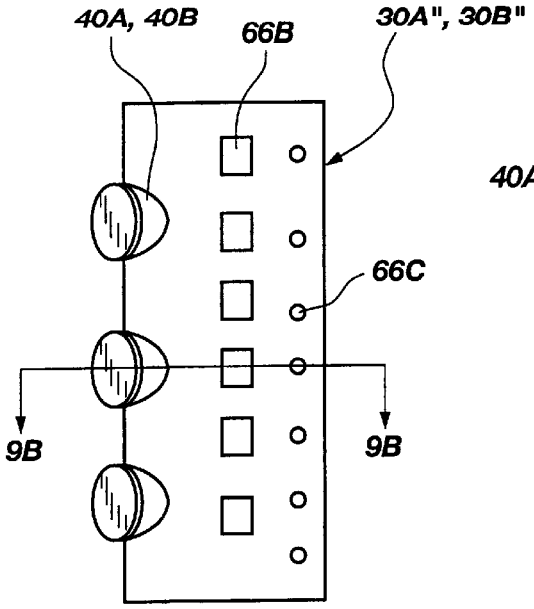
FIG. 9A is an isolated side view of the radially outermost gage-facing surface of an exemplary gage pad provided with a combination of aggressive PDC cutters, brick-shaped TCI cutting elements, and natural diamonds partially embedded therein.
Figure 9B:
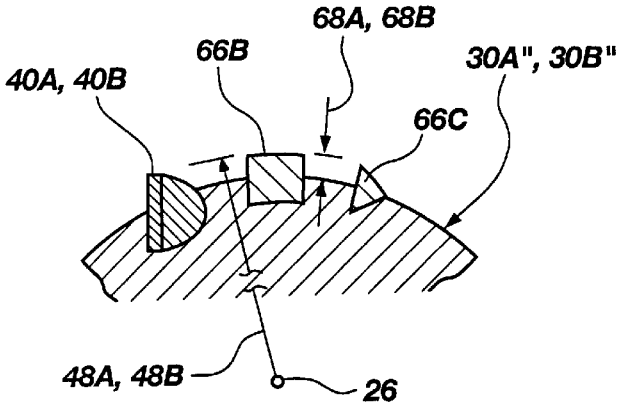
FIG. 9B is a truncated cross-sectional view taken along line 9B—9B of the gage pad shown in FIG. 9A.

FIGS. 9A and 9B depict an exemplary alternative gage pad 30A",30B" having a column comprising natural diamonds 66C, a column of TCI bricks 66B, and a column of PDC cutters 40A,40B each of which extend a preselected radial distance 68A, 68B.

Figure 10C:
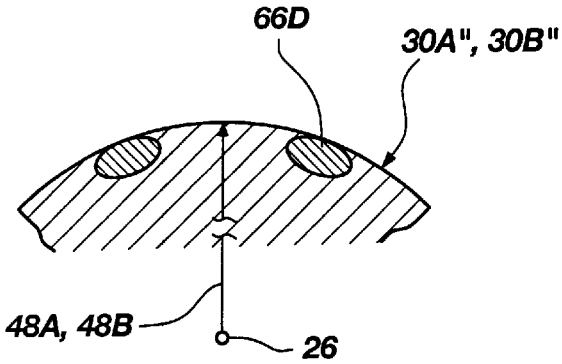
FIG. 10C is truncated cross-sectional view as taken along line 10C—10C of the gage pad shown in FIG. 10A with a plurality of tungsten carbide compacts having a generally smooth rounded profile being essentially flush mounted in the radially outward-facing surface of an exemplary gage pad which are particularly suitable for use in connection with alternative embodiments of the present invention such as the exemplary alternative embodiments shown in FIGS. 20A through 22.
Figure 11C:
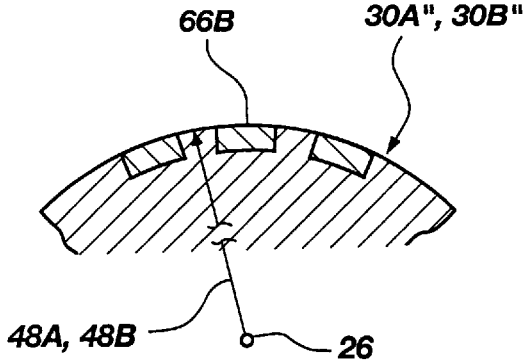
FIG. 11C is a truncated cross-sectional view taken along line 11C—11C of the gage pad as shown in FIG. 7A with a plurality of brick-shaped tungsten carbide cutting elements being flush mounted in the radially outward-facing surface of an exemplary gage pad which are particularly suitable for use in connection with alternative embodiments of the present invention such as the exemplary alternative embodiments shown in FIGS. 20A through 22.
Figure 10A:
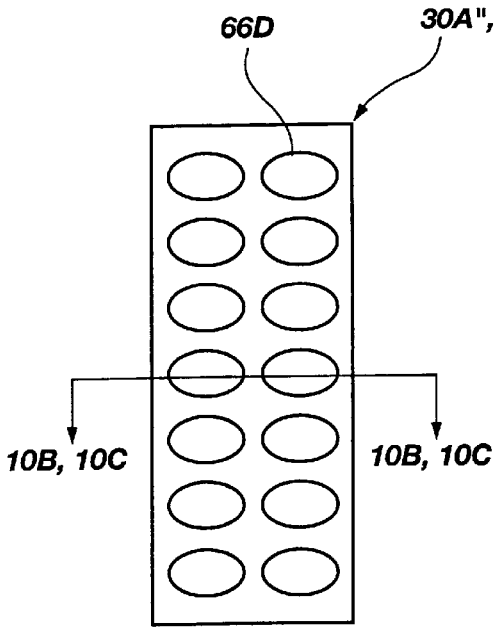
FIG. 10A is an isolated side view of the radially outermost gage-facing surface of an exemplary gage pad provided with a plurality of aggressive tungsten carbide compacts having a generally smooth rounded profile partially embedded therein.
Figure 10B:
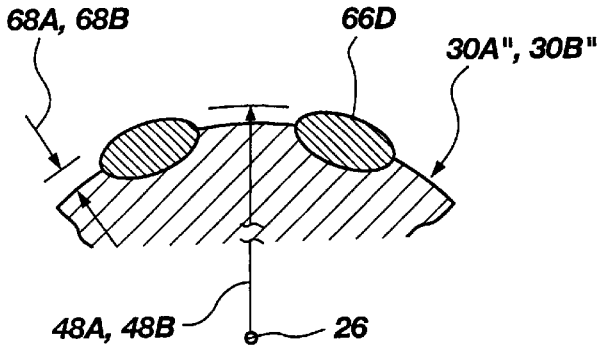
FIG. 10B is a truncated cross-sectional view taken along line 10B—10B of the gage pad shown in FIG. 10A.

FIGS. 10A and 10B depict an exemplary alternative gage pad 30A",30B" having a plurality of tungsten carbide inserts 66D, (TCI compacts) having a rounded or elliptical profile arranged in columns and wherein the major axis of each of TCI compacts 66D are oriented to be generally horizontal within the gage pad as shown. As with TCI compacts, or bricks, 66B, TCI compacts 66D can also be oriented vertically, or oriented at various angles and extend radially outwardly from the gage pad a distance 68A,68B.

Figure 11A:
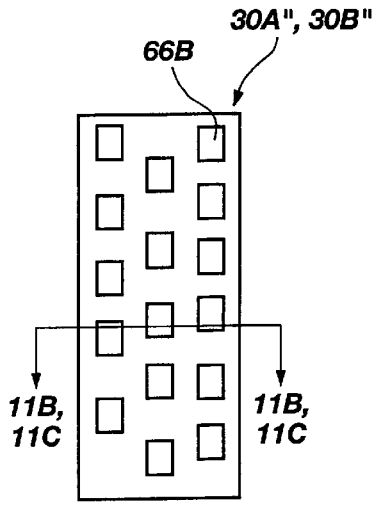
FIG. 11A is an isolated side view of the radially outermost gage-facing surface of an exemplary gage pad provided with a plurality of aggressive brick-shaped tungsten carbide cutting elements partially embedded therein.
Figure 11B:
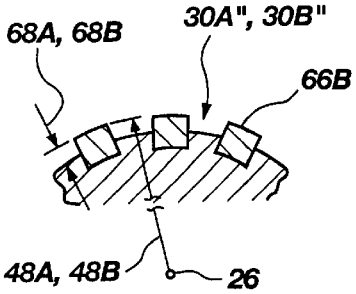
FIG. 11B is a truncated cross-sectional view taken along line 11B—11B of the gage pad shown in FIG. 11A.

FIGS. 11A and 11B depict an exemplary alternative gage pad 30A",30B" having a matrix comprised of only TCI bricks 66B extending at preselected radial distances 68A, 68B from the gage pad.

Figure 12A:
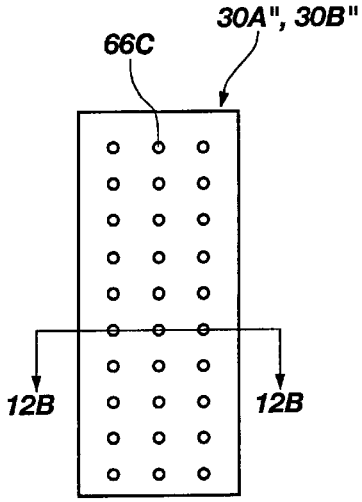
FIG. 12A is an isolated side view of the radially outermost gage-facing surface of an exemplary gage pad provided with a plurality of aggressive natural diamonds partially embedded therein.
Figure 12B:
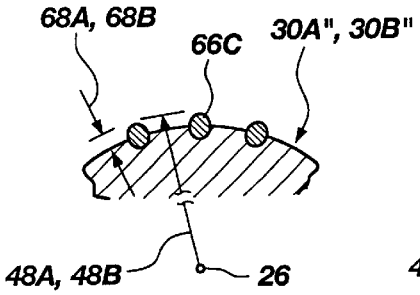
FIG. 12B is a truncated cross-sectional view taken along line 12B—12B of the gage pad shown in FIG. 12A.

FIGS. 12A and 12B depict an exemplary alternative gage pad 30A",30B" having a matrix comprised of only natural diamonds 66C extending radially outwardly therefrom at respectively preselected distances.

Figure 13A:
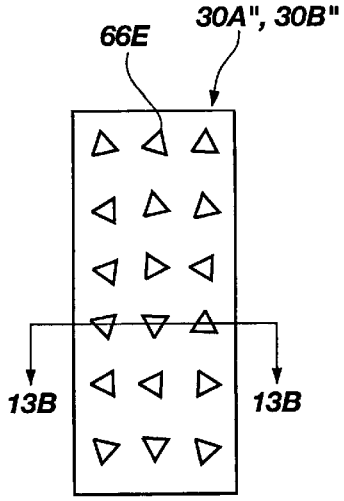
FIG. 13A is an isolated side view of the radially outermost gage-facing surface of an exemplary gage pad provided with a plurality of aggressive thermally stable product (TSP) cutting elements partially embedded therein.
Figure 13B:
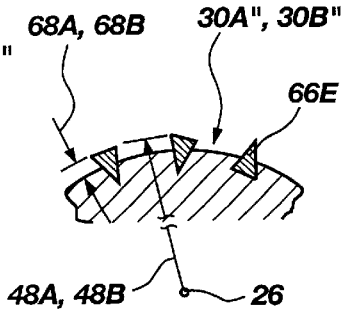
FIG. 13B is a truncated sectional view taken along line 13B–13B of the gage pad shown in FIG. 13A.

FIGS. 13A and 13B depict an exemplary alternative gage pad 30A",30B" having a matrix comprised only of a plurality of thermally stable products 66E (TSPs) having randomly placed sharp edges protruding from the surface of the gage pad. If desired, TSPs 66E may have edges strategically placed to protrude in particular orientations and radial distances 68A, 68B from the gage pad.

Figure 14A:
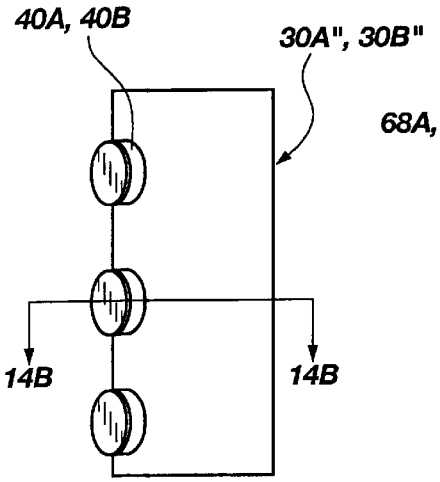
FIG. 14A is an isolated side view of the radially outermost gage-facing surface of an exemplary gage pad provided with a plurality of aggressive PDC cutters partially embedded therein.
Figure 14B:
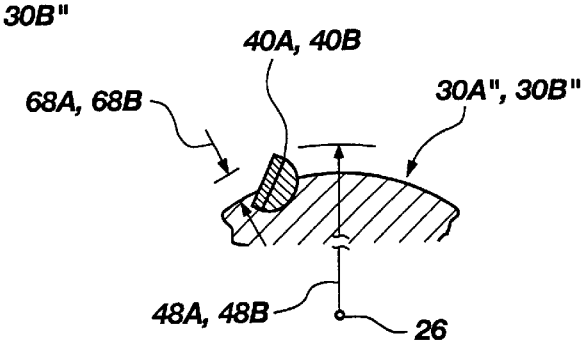
FIG. 14B is a truncated cross-sectional view taken along line 14B—14B of the gage pad shown in FIG. 14A.

FIGS. 14A and 14B depict an exemplary alternative gage pad 30A", 30B" having a column comprised of a plurality of PDC cutters 40A,40B extending along the leading edge or section of the gage pad and extending radially outward therefrom preselected distances 68A,68B.

With respect to the various degrees of aggressivity in which different types and arrangements of cutters, or cutting elements or surfaces, can be provided about the maximum circumference, or gage, of a drill bit in accordance with the present invention, the following general guidelines are provided in which the most aggressive cutting elements will be described in descending order with the least aggressive being described lastly.

Figure 15:
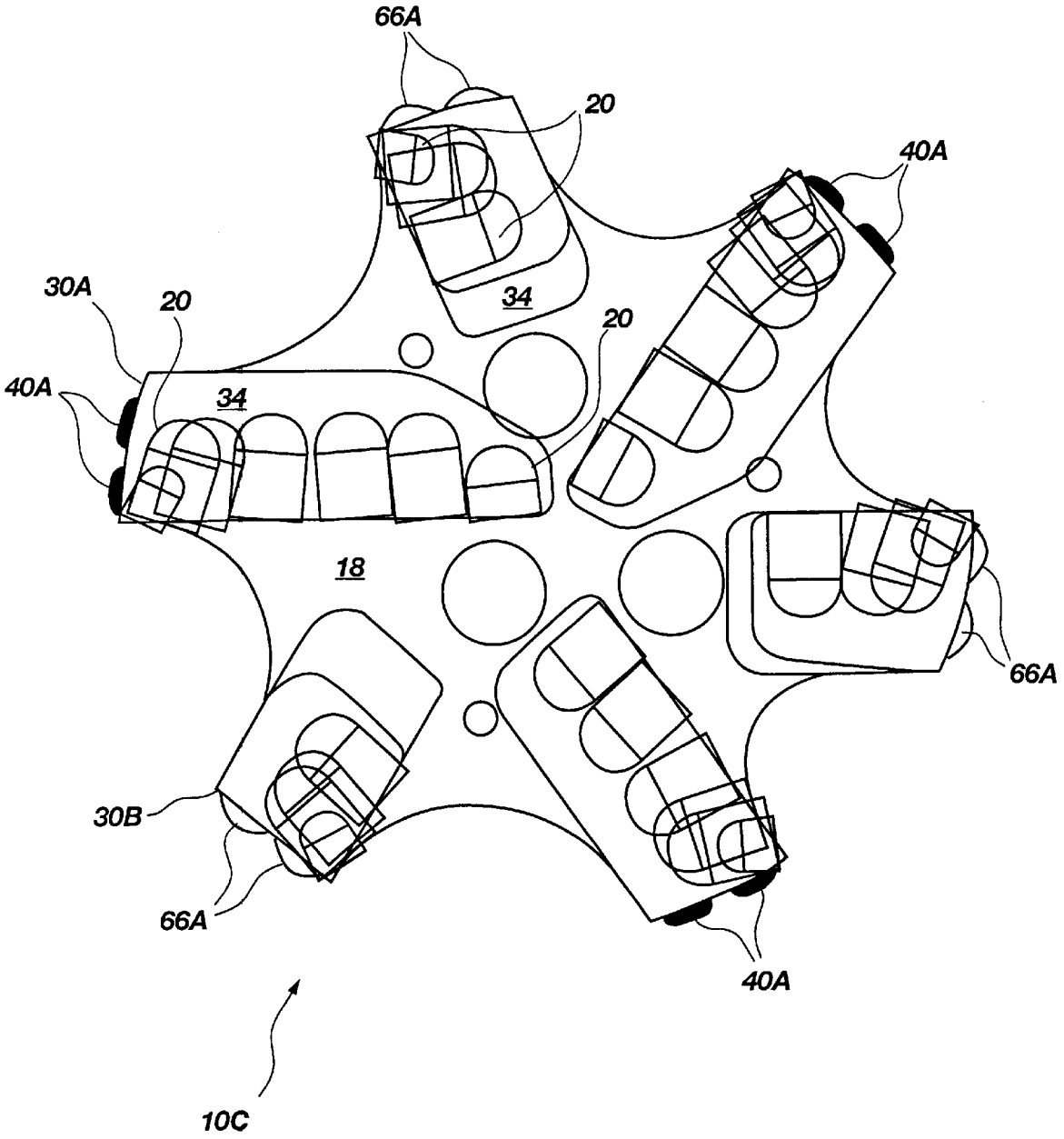
FIG. 15 is a bottom view of an exemplary drill bit in which gage pads having relatively more aggressive PDC compacts partially embedded therein alternate with gage pads having relatively less aggressive tungsten carbide cutting elements partially embedded therein.

Overall, the most aggressive type of gage cutters, or cutting elements, are PDC cutters, or alternatively CBN cutters, such as PDC cutters 40A,40B, having large cutting surface areas and which are mounted so as to have a negative backrake as illustrated in FIG. 5. A PDC cutter with a backrake of approximately 0°, such as PDC cutter 40A, shown in FIG. 15, is the second most aggressive cutting element arrangement. Furthermore, PDC cutters are available in which the superabrasive table, mounted on the supporting substrate of the cutter, is provided with certain cutting surface, or edge, geometries that may further influence the aggressivity of the cutter in addition to the selected degree of backrake that the overall cutter is provided with. Generally speaking the actual cutting surface, or edge, of the provided PDC cutters preferably protrudes outwardly from the gage pad surface in which they are mounted, distance 68A, 68B by more than 0.050 inches (approximately more than 1.25 mm). It should be understood however, that various cutting elements mounted on, or associated with a particular gage pad can have radial distances, depicted as 68A, 68B throughout the drawings, which vary from cutting element to cutting element on the same gage. That is distance 68A for one cutter mounted on what is to generally be a more aggressive gage pad, can have a different distance 68A as compared with another cutter of the same type, or different type, mounted on or associated with that particular gage pad.

Generally, the next most aggressive gage cutting element arrangement is the provision of natural or synthetic diamond particles, or chips, or other superabrasive containing material such as TSP particles partially embedded or otherwise disposed on the radially outermost gage-facing surface of a preselected gage pad as previously described. Factors such as the quantity, size, amount of protrusion, and the edge orientation of the TSP particles from the radially outermost gage-facing surface of the gage pad will determine the overall relative aggressivity of natural or synthetic diamond particles compared to TSP particles. That is, if relatively large natural or synthetic diamonds protrude relatively far from the surface in which the diamonds are partially embedded, such diamonds would likely form a cutting element disposed on a gage pad which would be more aggressive than a cutting element disposed on a gage pad having approximately the same surface area of TSP particles in which the edges of the TSP are not specifically oriented to protrude from the radially outermost gage-facing gage pad surface, or in which the size of the TSP particles are generally smaller as compared to diamond particles or chips. The particular size, orientation, and amount of projection from the outermost gage surface in which each particular diamond particle or TSP particle is partially embedded or disposed, will likely determine the degree of aggressivity of such particles. Thus, natural or synthetic diamond particles and TSP particles can be regarded as being of generally the same aggressivity, depending on at least the above specific factors.

Generally the third most aggressive gage cutting element arrangement is the provision of hard facing material on a rough surface such as that formed by broaching as previously discussed and depicted in FIGS. 1 and 2. Again the total surface area, the extent in which the rough portions, or broached portions, protrude from the radially outermost gage-facing surface of the gage pad, and the particular characteristics of the hard facing material and manner in which it is disposed thereon, will influence the degree of aggressivity.

The fourth generally most aggressive, or conversely the generally least aggressive, gage cutting element arrangement is the provision of TCI compacts partially, or nearly fully embedded in the radially outermost gage-facing surface of the gage pad. As with the other types of representative gage cutting elements, TCI compacts can be provided so as to have a relative high amount of protrusion, a geometrical shape having relatively sharp edge portions, and having a relatively small exposed surface area on an individual compact basis and thus each of these characteristics will contribute to an increase in the level of aggressiveness of a TCI compact. Conversely, a TCI compact provided to have a low amount of protrusion, a geometrical shape having relatively rounded edge portions, and having a relatively large exposed surface are characteristics which will contribute to a decrease in the level of aggressiveness of a TCI compact. An exemplary TCI gage cutting element could comprise TCI bricks 66B as shown in FIGS. 9A and 9B. A slightly less aggressive gage cutting element would be TCI compacts partially embedded in the radially outermost gage-facing gage pad surface having a relative low amount of protrusion, a geometrical shape having relative rounded edge portions, and being of relatively large exposed surface area on an individual compact basis. Such a slightly less aggressive TCI gage cutting element could comprise oval shaped TCI compacts 66C as shown in FIGS. 10A and 10B. An even less aggressive TCI compact, could for example, be provided to have a circular cross-section, or button shape, having a relatively large exposed surface area, in which the amount of protrusion from the radially outermost gage-facing gage pad surface is at a minimum. An example of such round TCI compacts which could comprise a very low-aggressivity cutting element are shown in FIGS. 6A and 6B of the drawings.

It should be understood that in addition to the specific types of representative cutting elements discussed in the immediately preceding general guideline, that there are many possible variations and combinations thereof. For example, the total quantity and total surface area in which one type or more of cutter is provided on a given gage pad will affect the overall aggressivity of that gage pad. Furthermore, upon considering the above general guidelines it will become apparent that other suitable cutting elements which are not specifically addressed in the preceding general guideline could likely be used to provide a gage pad with a desired level of aggressivity in comparison to other gage pads preselectively positioned circumferentially about the drill bit while simultaneously allowing such gage pad's ability to transmit, to a preselected extent, lateral forces from the drill bit to the wall of the bore hole to maximize the overall quality of the bore hole.

Reference now being made in general to FIGS. 15 through 18 respectively illustrating bottom views of exemplary drill bits 10C, 10D, 10E, and 10F having gage pads of differing aggressivity being arranged in a variety of representative preselected patterns.

Drill bit 10C depicted in FIG. 15 is provided with lower face 18 and cutting elements 20 mounted on blades 34 as previously described. Furthermore, drill bit 10C is provided with relatively more aggressive gage pads 30A and relatively less aggressive gage pads 30B in an alternating pattern about the circumference of the drill bit. That is every other gage pad 30A is relatively more aggressive than the two adjacent gage pads 30B located circumferentially to either side. In particular, more aggressive gage pad 30A is provided with a preselected quantity of gage cutting, on-gage pad cutting elements in the form of PDC cutters 40A that are arranged in a preselected pattern and which are partially embedded within the radially outermost gage-facing surface of gage pad 30A, and are oriented to have 0° siderake and 0° backrake. However, PDC cutters 40A could alternatively be oriented to have a positive or negative amount of either siderake, backrake, or both to alter the magnitude of the total aggressivity of gage pads 30A. Less aggressive gage pads 30B are provided with gage cutting elements in the form of a preselected number of generally round-shaped TCI compacts 66B partially embedded within the radially outermost gage-facing surface of lesser aggressive gage pad 30B a preselected amount and are arranged in a preselected pattern on at least one gage pad. TCI compacts 66B are also shown as being oriented with 0° siderake and 0° backrake. However, as with PDC cutters 40A provided on more aggressive gage pad 30A, one or more of the plurality of TCI compacts 66B could alternatively be oriented to have a preselected side rake, back rake, or both. Furthermore, drill bit 10C could alternatively be provided with more than a total of six blades having at least one gage pad thereon of a preselected aggressivity. Conversely, less than a total of six blades having at least one gage pad thereon could alternatively be provided. Furthermore, a given blade could alternatively be provided with more than one outermost gage-facing surface in which cutting elements are to be at least partially embedded and protrude a preselected amount therefrom.

Figure 16:
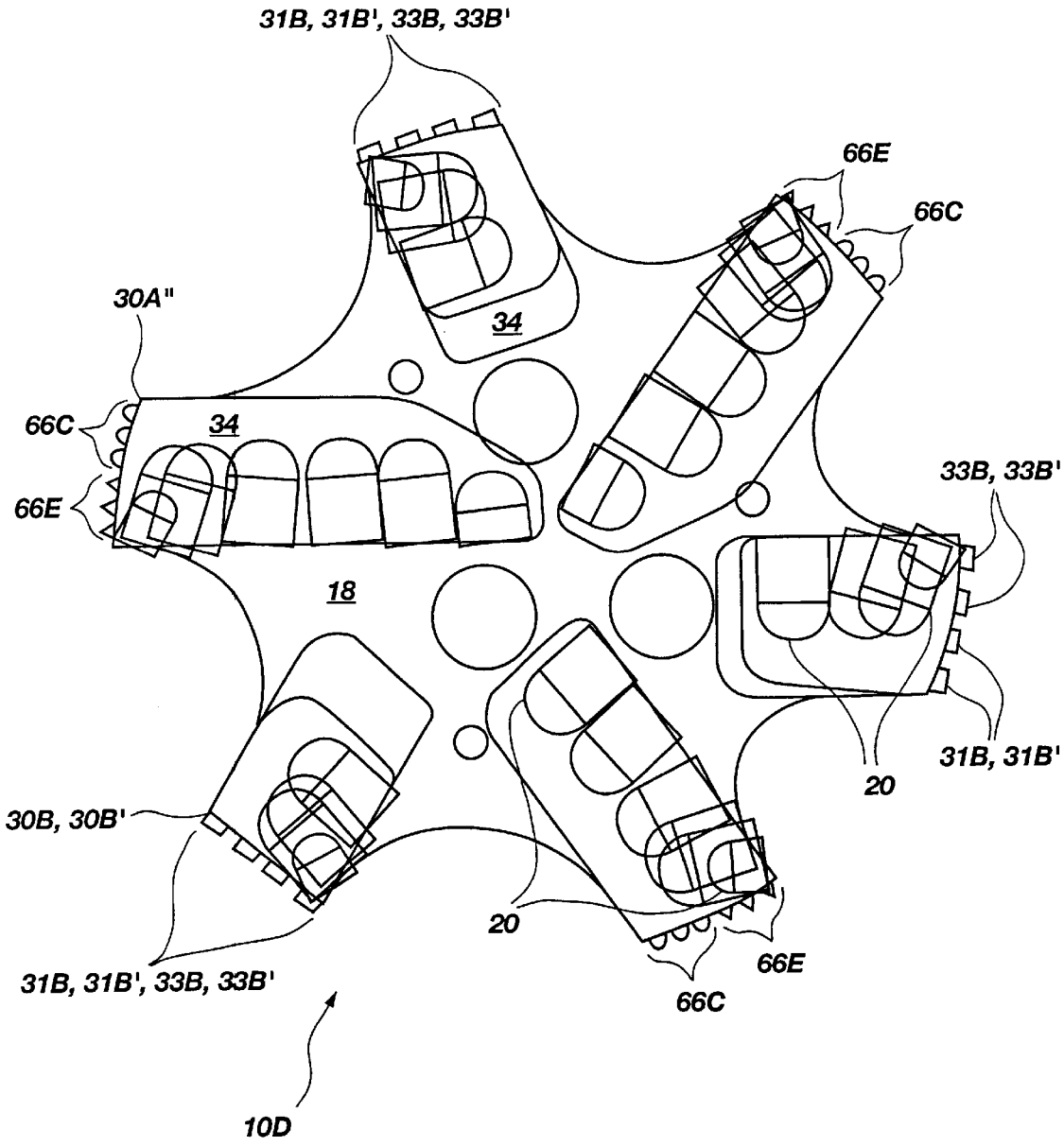
FIG. 16 is a bottom view of an exemplary drill bit in which gage pads having natural diamonds partially embedded therein alternate with gage pads having TSP particles partially embedded therein and wherein one set of gage pads can be more aggressive than the other set of gage pads depending on the amount of protrusion, sharpness and orientation of the edges of the respective diamonds and TSP particles.

Drill bit 10D illustrated in FIG. 16 is also provided with six blades 34. Every other blade is provided with a more aggressive gage pad 30A" having a combination of natural diamond particles 66C and TSP particles 66E at least partially embedded within the radially outermost gage-facing surface of gage pad 30". The remaining, every other blades are provided with a less aggressive gage pad 30B having raised portions 31A having superabrasive particles 35 partially embedded therein to preselected depths. Such superabrasive particles can be diamond particles and preferably raised portions 31A are separated by recesses 33B. Alternatively, less abrasive gage pads 30B could be substituted with similarly less aggressive alternative gage pads 30B' provided with raised portions 31B' having a hard facing material 35' disposed thereon and wherein such raised portions are separated by recesses 33B'. Although, the superabrasive particles have been discussed with respect to being partially embedded to preselected depth, it is to be understood that in general, not just with respect to drill bit 10D, the depth of embedment of the superabrasive particles in effect controls the amount of exposure of the superabrasive particles of a given size so that the term "depth" and "exposure" can in many instances be generally considered synonymous.

Figure 17:
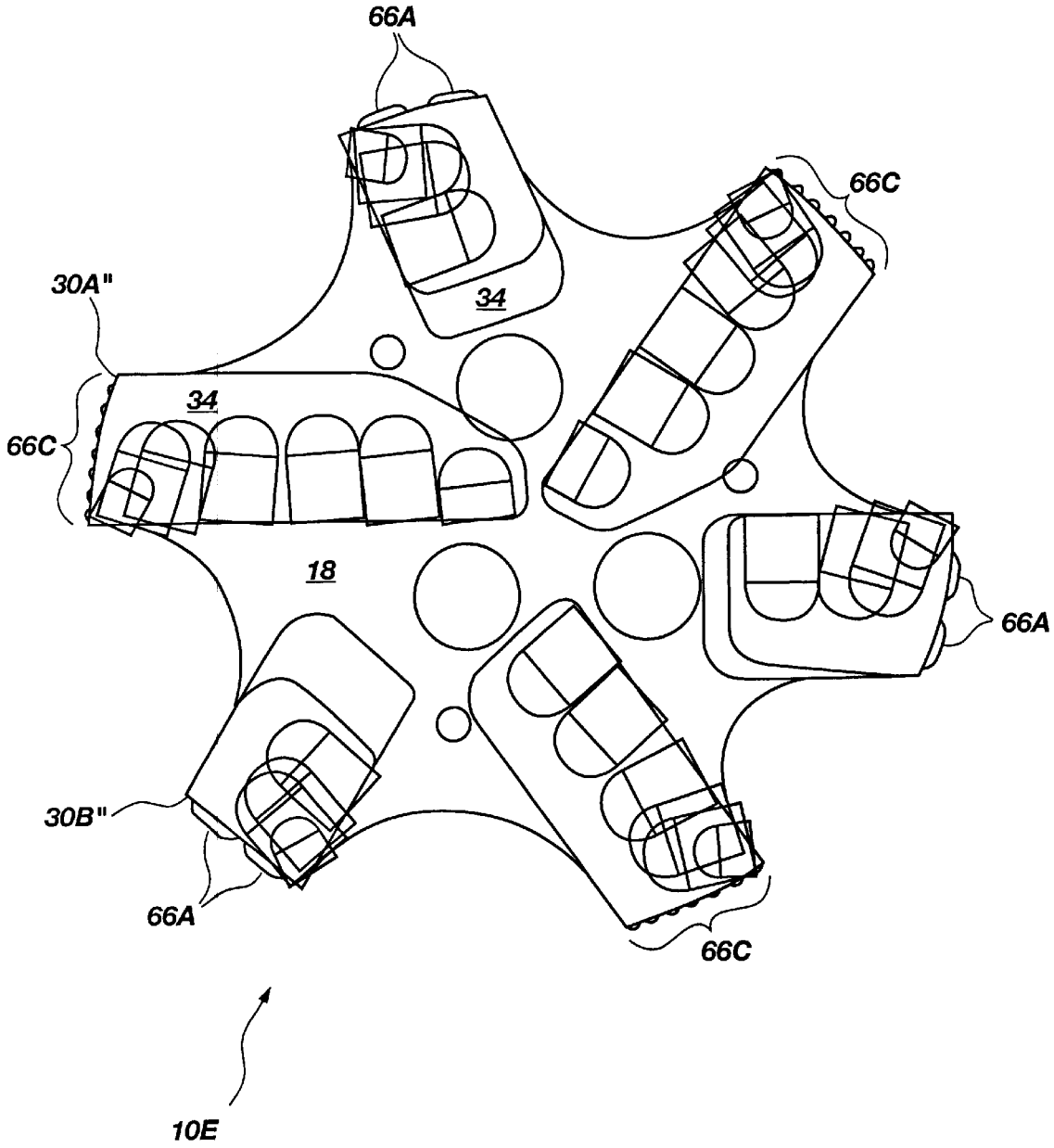
FIG. 17 is a bottom view of an exemplary drill bit in which gage pads having relatively more aggressive natural diamonds partially embedded therein alternate with gage pads having relatively less aggressive TCI compacts partially embedded therein.

Drill bit 10E illustrated in FIG. 17 is also provided with six blades 34, however as described earlier, more or fewer blades and/or gage pads can be utilized, and can be provided in an even-numbered quantity, or in an odd-numbered quantity. As drill bits 10C and 10D, drill bit 10E are constructed to have circumferentially alternating more aggressive gage pads 30A" having a plurality of diamond particles at least partially embedded therein and which extend a preselected distance from the radially outermost gage-facing surface of each gage pad 30A". The remaining circumferentially intervening less aggressive gage pads 30B" have a plurality of TCI compacts 66C of a generally round profile preferably partially embedded and extending a preselected distance from the radially outermost gage-facing surface of each gage pad 30B".

Figure 18:
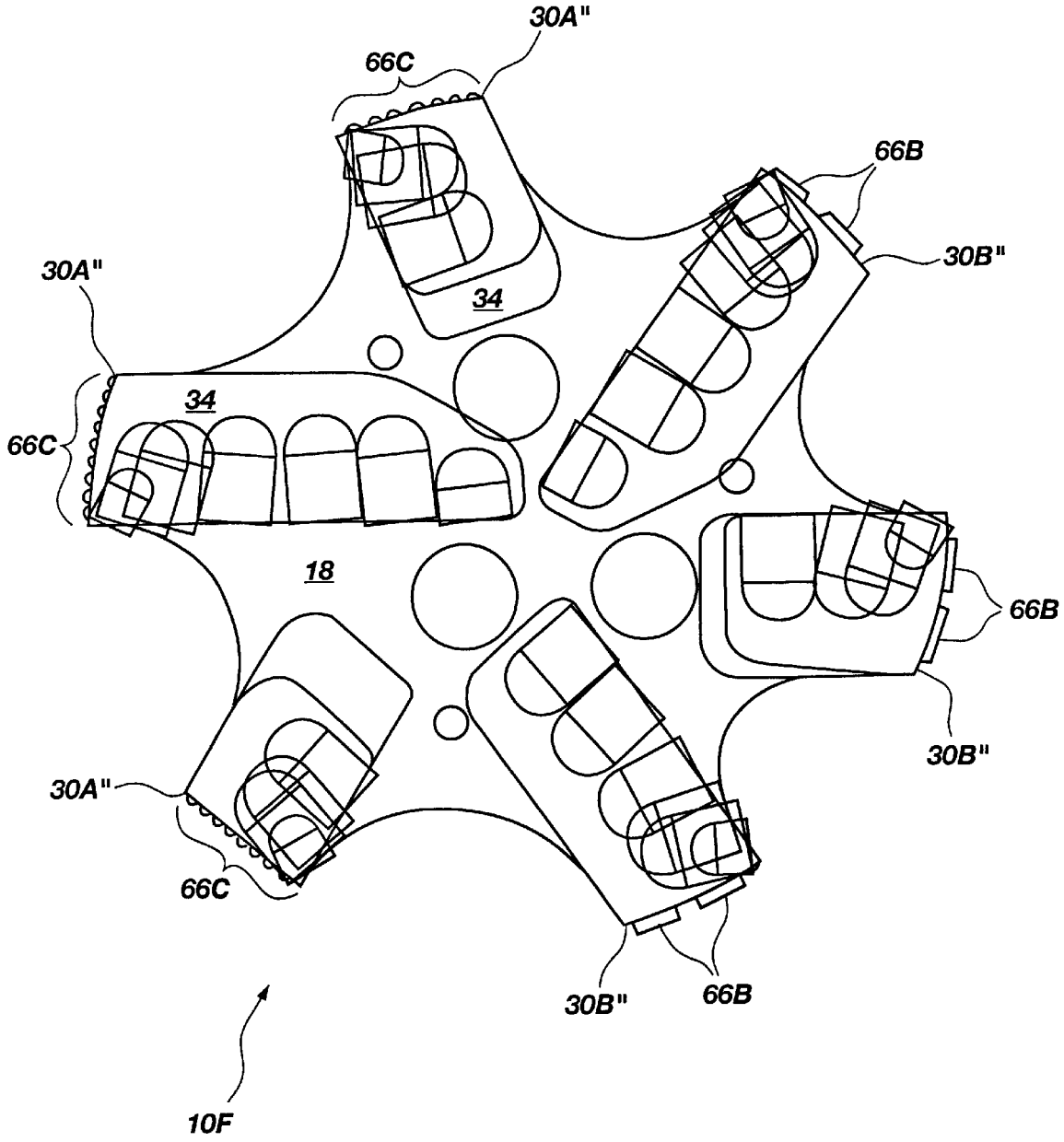
FIG. 18 is a bottom view of an exemplary drill bit in which three adjacent gage pads are provided with relatively more aggressive natural diamonds partially embedded therein and the remaining three adjacent gage pads are provided with relatively less aggressive TCI compacts partially embedded therein.

Unlike the symmetrical, every other alternating pattern of a more aggressive gage pad being circumferentially adjacent two less aggressive gage pads as shown in FIGS. 15 a through 17, drill bit 10F of FIG. 18 is provided with a non-symmetrical gage pad aggressivity pattern wherein three more aggressive gage pads 30A" are located generally on the same side of drill bit 10F. That is gage pads 30A" having diamond particles 66C partially embedded within and protruding a preselected distance from the radially outermost gage-facing surface of each gage pad 30A" are positioned on the left side of drill bit 10F as viewed in FIG. 18. Whereas less aggressive gage pads 30B" having TCI brick-shaped compacts 66B partially embedded and protruding a preselected distance from the radially outermost gage-facing surface of each gage pad 30B" are generally located on the opposite, or right side, of drill bit 10F as viewed in FIG. 18. Thus, a non-symmetrical gage pad aggressivity pattern can also be used to provide a drill bit having particular side cutting capabilities while simultaneously transmitting lateral forces from the drill bit to the inner wall of the particular bore hole being drilled in accordance with the present invention.

Of course, many other symmetrical and non-symmetrical aggressive gage pad patterns can be provided in lieu of the particular exemplary patterns show in FIGS. 15–18 by combining preselected more aggressive, less aggressive gage pad placement. For example, a drill bit having two more aggressive gage pads could be provided circumferentially adjacent each other followed by two less aggressive pads followed in turn by a second set of two more aggressive gage pads followed in turn by a second set of two less aggressive gage pads. Furthermore, a drill bit could be provided with five relatively more aggressive gage pads and have but one relatively less aggressive gage pad, or vice versa. Many such combinations will not be apparent in light of the present invention as disclosed and are to be regarded as being within the ambit thereof.

Figure 19:
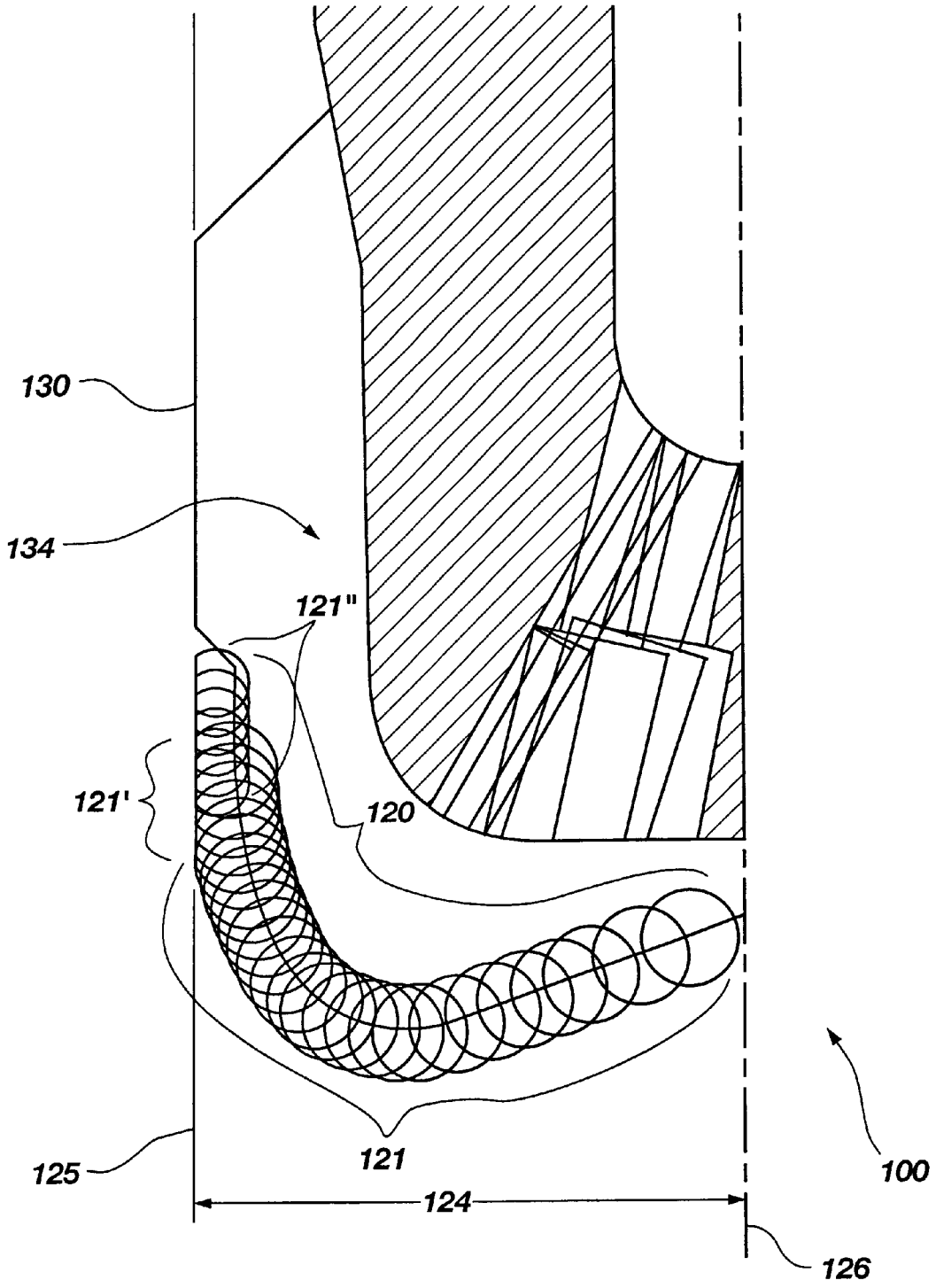
Fig. 19 (PRIOR ART)
FIG. 19 is a truncated cross-sectional view showing the superimposed respective tangential paths of each cutter positioned on the face of a prior art drill bit as it rotates about its central longitudinal axis, in particular

A truncated cross-sectional side view of a representative prior art drill bit 100 having the respective tangential paths of a plurality of cutters 120 being superimposed within the view as drill bit 100 rotates about a longitudinal central axis 126 is shown in FIG. 19 of the drawings. As can be seen in FIG. 19, the lower most face cutters are relatively larger diameter, fully circular-shaped cutters 121 which are symmetrically circular, or non-truncated. Cutters 121' located more upwardly along the face of drill bit 100, have truncated exposed faces in order for such cutters 121' not to extend radially beyond imaginary gage 125 which is generally flush and parallel with the radially outermost gage-facing surface of gage pad 130 of drill bit 100. Typically, cutters 121' are ground to have a non-symmetrical, or flattened profile along the gage-edge of the cutter. Relatively smaller diameter cutters 121" located upwardly along the face of drill bit 100, are also traditionally truncated so that such cutters have an exposed face which does not extend beyond the radially outermost gage-facing surface of gage pad 130. Gage pad 130, shown being a continuation of blade 134, is devoid of cutters, or cutting elements, on the radially outermost gage-facing surface thereof. Thus, such cutters 121' and 121", being so positioned and being so trimmed or truncated, do not extend beyond the radially outermost gage-facing surface of gage pad 130, such cutters in effect will determine the gage of the bore hole that drill bit 100 will ultimately provide when put into service. This is because as the drill bit engages the formation the larger diameter cutters 121, being the longitudinally leading most cutters, will initially cut the borehole with cutters 121' progressively engaging the formation so as to approach the final gage of the bore hole to be drill as the bit progresses followed by cutters 121" serving to further finish, or clean up, the gage of the bore hole to its final diameter. Therefore, it is important to note that although the radial outmost-facing surface of respective gage pads 130 may not be provided with any aggressive cutters or materials directly thereon, cutters such as cutters 121' and 121", which are positioned circumferentially and longitudinally proximate to respective gage pads 130 in accordance with traditional, known practices of the art, are regarded as being associated with and directly responsible for cutting the gage of the borehole as a given respective gage pad rotates about the longitudinal axis of the drill bit as the drill bit progresses through the formation. That is, those cutters such as cutters 121' and cutters 121" which are positioned circumferentially and longitudinally proximate respective gage pads are regarded as being "gage cutters" which will ultimately determine the gage of the drill bit in that particular circumferential region of the drill that is proximate to a given gage pad notwithstanding that the subject cutters are merely located circumferentially and longitudinally proximate respective gage pads and are not mounted directly on the outermost gage-facing surface of respective gage pads per se. Thus, depending on the degree, or level, of aggressiveness each cutter 121, 121', and 121" has, which as discussed above is influenced by such factors as cutting element abrasiveness, size, rake angle, and the degree or extent of radial protrusion. However, it is a common, time honored practice within the art, that circumferentially spaced cutters, such as cutters 121' and 121" which are respectively associated with respective gage pads, each of the subject cutters will be provided with essentially the same or nearly the same level of aggressiveness. That is, regardless of where a given cutter 121' and/or cutter 121" may be circumferentially positioned so as to be associated with, and responsible for determining the gage of the drill bit in the particular circumferential region in which a respectively associated gage pad may be positioned, all such cutters will generally be provided with the same, or essentially the same, degree of aggressiveness.

Therefore, the present invention when taken in a broad sense, provides the industry with drill bits having a plurality of circumferentially spaced gage pads with selected gage pads being provided with outermost gage-facing surfaces having cutting elements which are of different levels of aggressiveness in comparison to outermost gage-facing surfaces of other selected gage pads as described above and as illustrated in respectively identified drawings is not limited to such. The present invention is also suitable for use in connection with drill bits having gage pads that have no such aggressive cutting elements disposed, or mounted, directly on the gage pad such as on an outermost gage-facing surface thereof as will become apparent upon reading the following description and viewing the various drawings depicting exemplary alternative embodiments of the present invention as set forth below.

Figure 20A:
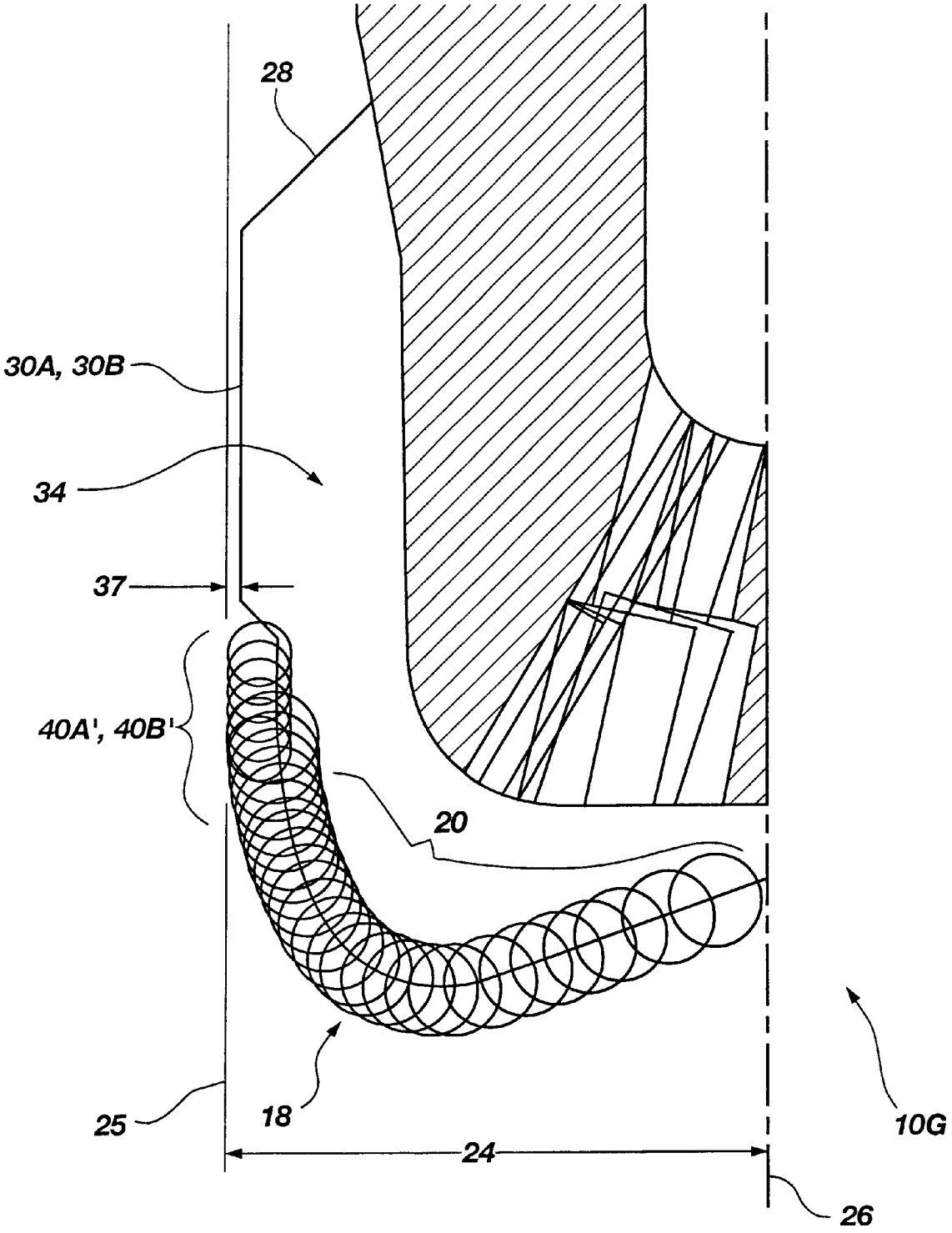
FIG. 20A is a truncated cross-sectional view showing the superimposed respective tangential paths of each cutter positioned on the face of an exemplary drill bit as it rotates about its central longitudinal axis, in particular
Figure 20B:
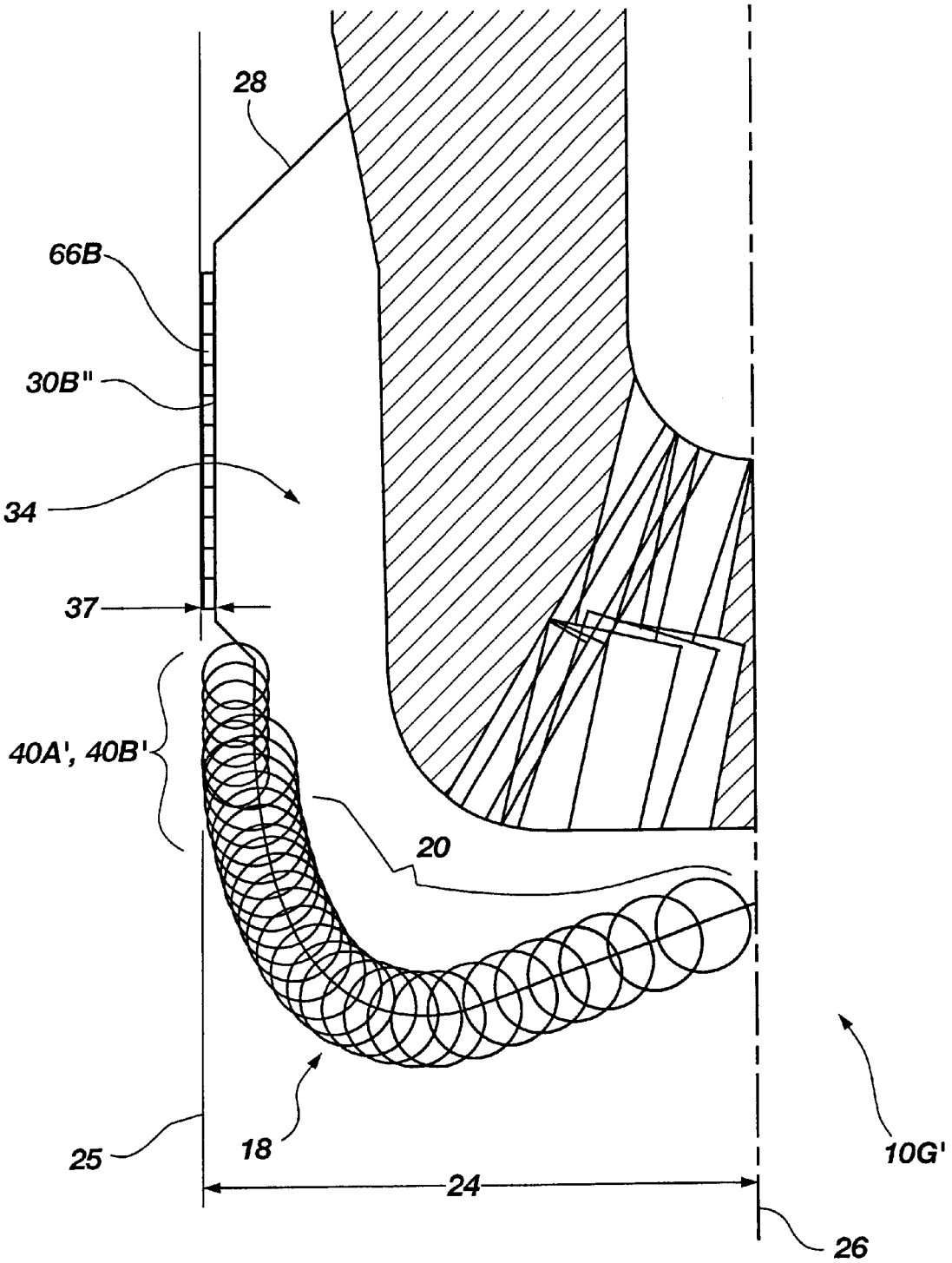
FIG. 20B is a truncated cross-sectional view showing the superimposed respective tangential paths of each off-gage pad cutter positioned on the face of an alternative exemplary drill bit, similar to the drill bit shown in FIG. 20A, however the drill bit of FIG. 20B has also been provided with aggressive tungsten carbide inserts on the radially outermost gage-facing surface of selected gage pads
Figure 21A:
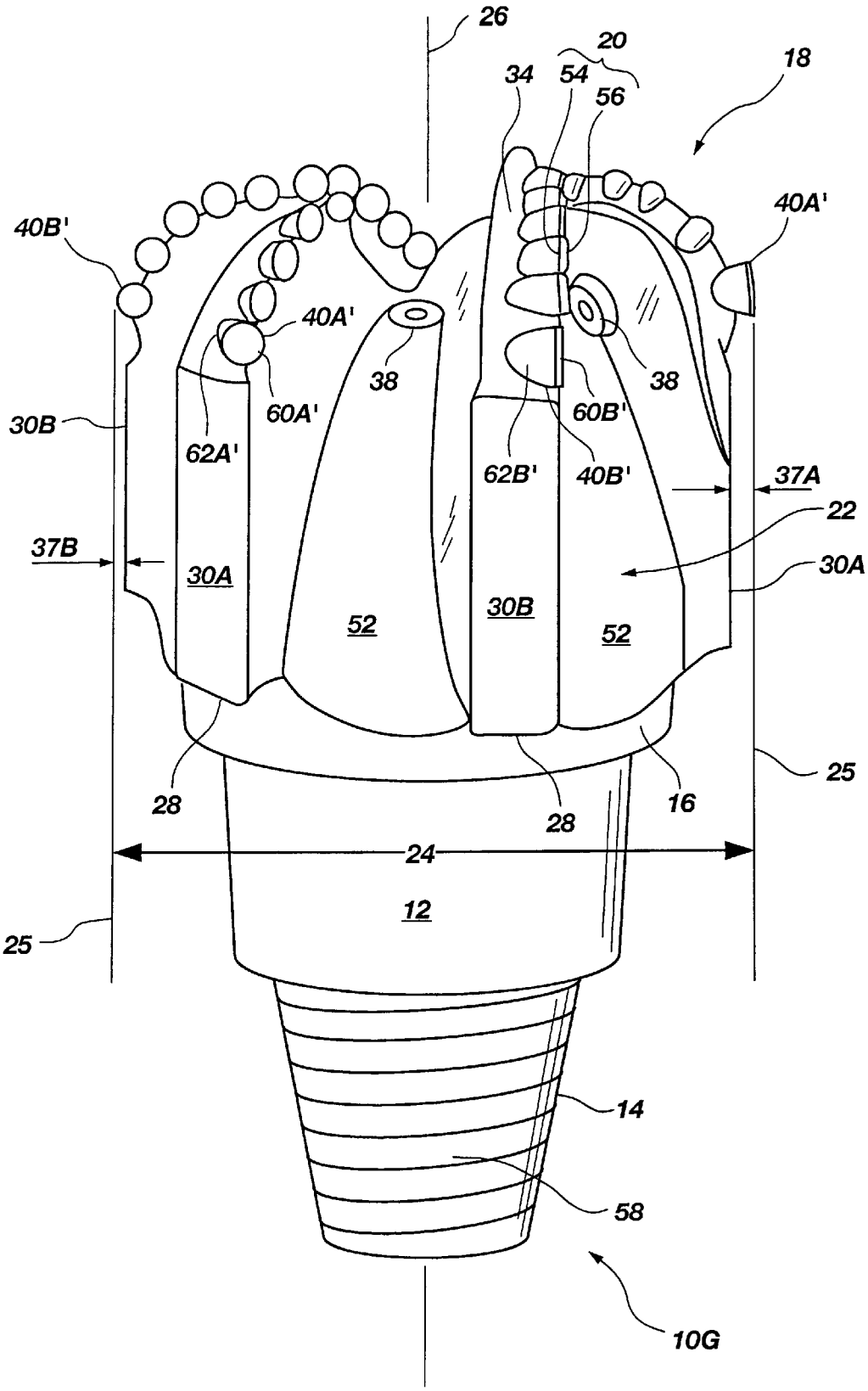
FIG. 21A is a side view of the exemplary drill bit shown in FIG. 20A depicting a off-gage pad cutter associated with and in longitudinal proximity to each gage pad and wherein the selectively aggressive off-gage pad cutters protrude beyond the radially outermost gage-facing surface of the gage pads.
Figure 21B:
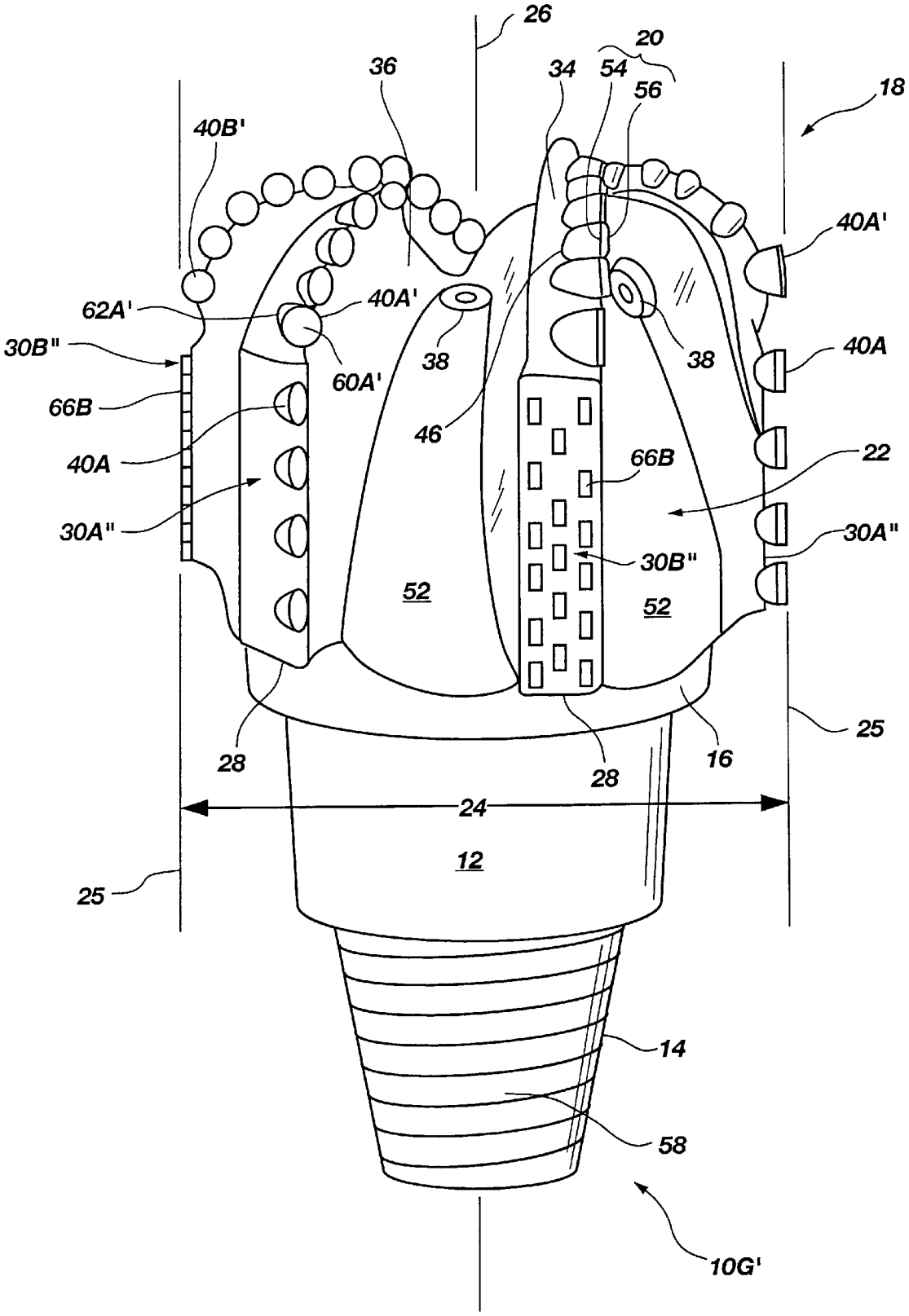
FIG. 21B is a side view of the alternative exemplary drill bit such as shown in FIG. 20B depicting an off-gage pad cutter associated with and in longitudinal proximity to each gage pad and wherein a plurality of relative more aggressive PDC type on-gage pad cutters are mounted on and protrude beyond the radially outermost gage-facing surface of selected gage pads and a plurality of relative less aggressive TCI compacts are partially embedded and protrude less aggressively beyond the radially outwardly facing surface of selected gage pads.
Figure 21C:
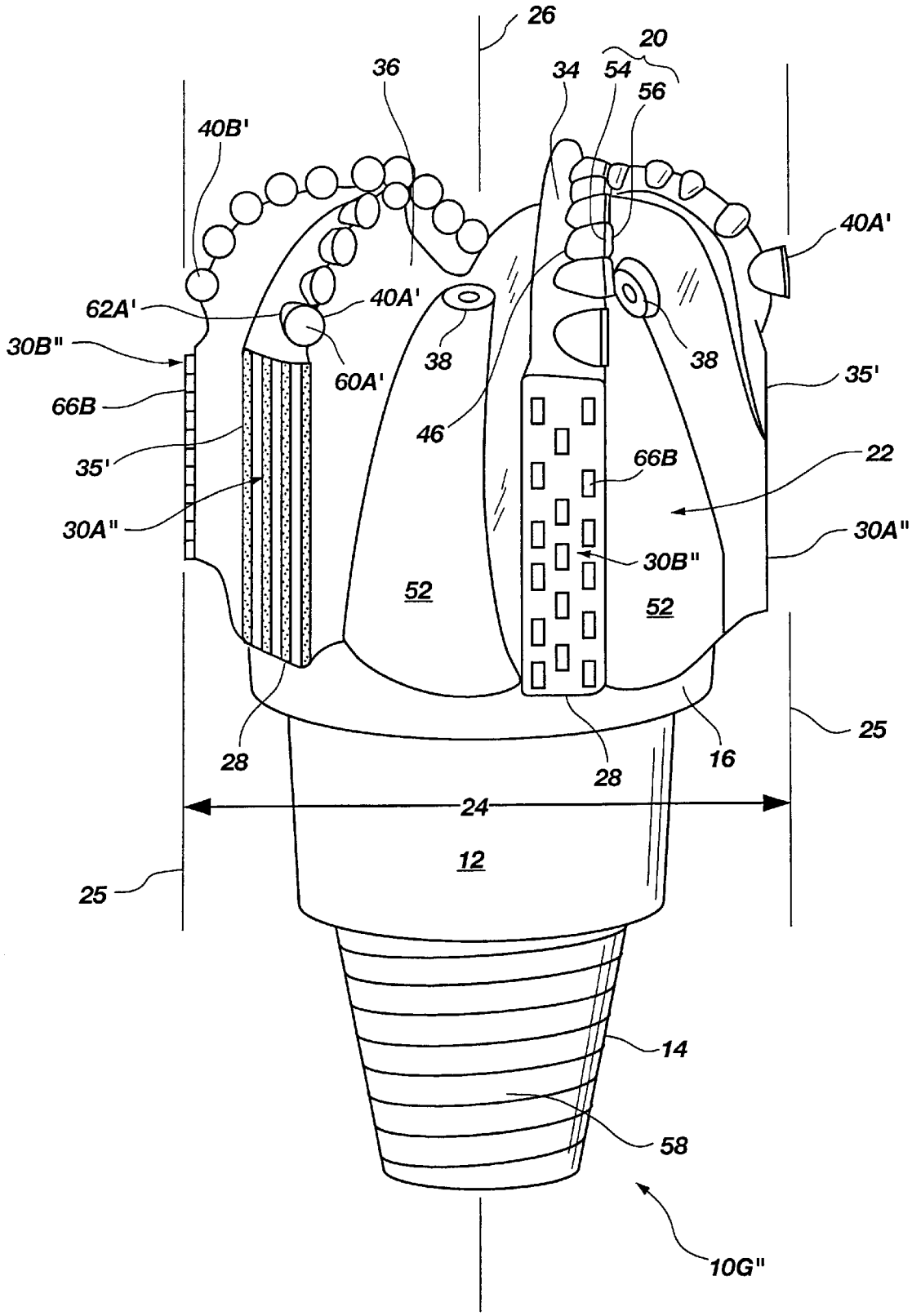
FIG. 21C is a side view of the alternative exemplary drill bit such as shown in FIG. 20B depicting an off-gage pad cutter associated with and in longitudinal proximity to each gage pad and wherein a plurality of flush-mounted TCI compacts that have been embedded on the radially outermost gage-facing surface of selected gage pads and depicting a radially outermost gage-facing surface of a representative gage pad being at least partially covered by regions of abrasive/hardfacing material that has been disposed on the radially outermost gage-facing surface so as to be essentially or nearly flush therewith.
Figure 22:
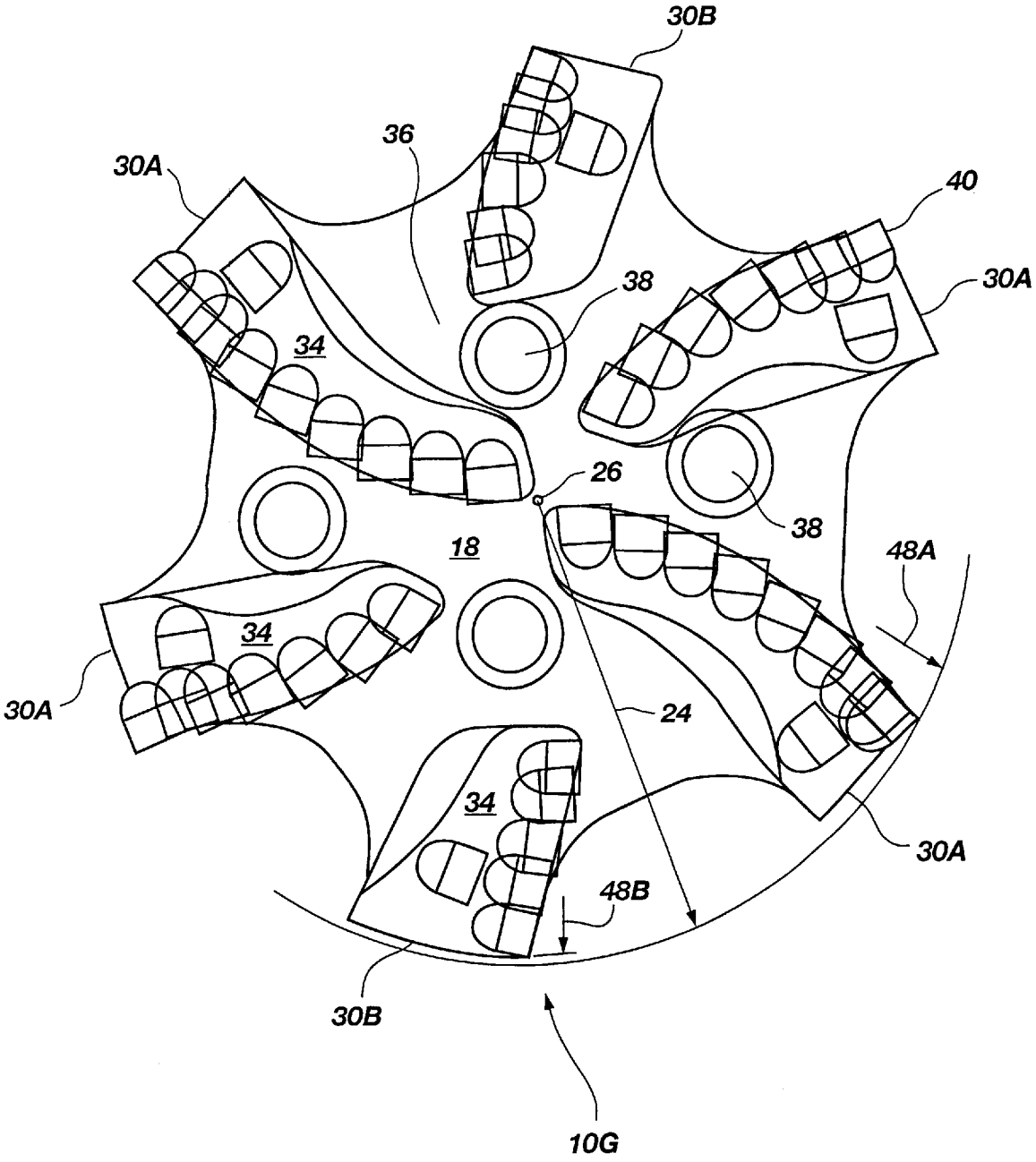
FIG. 22 is a bottom view of a drill bit such as shown in FIG. 20.

Reference now being made to FIGS. 20A, 20B, 21A, 21B, 21C, and 22, which depict drill bit 10G, and with respect to FIGS. 20B, and 21B, an alternative drill bit 10G', embodying the present invention. Both drill bits 10G and 10G' are provided with face cutters 20, which are mounted on face 18 as previously described and illustrated. However, gage pads 30A and 30B of drill bit 10G are shown as being completely devoid of any on-gage pad cutters, or cutting elements, whatsoever. While drill bit 10G' is shown having alternative off-gage pad cutters, or cutting elements, 40A' and 40B' located longitudinally and circumferentially proximate to alternative gage pads 30A" and 30B" while also having on-gage pad cutters, or cutting elements, such as representative cutting elements 40A. Off-gage pad gage cutters 40A' and 40B' serve the same purpose as previously discussed on-gage pad gage cutters 40A and 40B, in that each provides different respective-aggressive side, or gage, cutting capabilities, but instead of being mounted directly on the radially outermost gage-facing surface of gage pads 30A and 30B, alternative gage cutters 40A' and 40B' are not mounted directly on the radially outermost gage-facing surface, but instead are preferably mounted just slightly longitudinally there below, as illustrated in FIGS. 20A, 20B, and slightly above such gage pad surfaces when the exemplary drill is view as oriented in FIGS. 21A, 21B. Thus off-gage pad cutters 40A' and 40B' are preferably mounted longitudinally short of the radially outermost gage-facing surface of each gage pad and, are conveniently mounted on the face portion 18 of drill bit 10G, 10G'. As can be seen in the superimposed cutter profiles made by face cutters 20 and off-gage pad cutters 40A' and 40B' in FIGS. 20A and 20B, cutters 40A' and 40B' are not truncated and are thus able to aggressively engage the formation being drilled by drill bit 10G, 10G'. Thus, gage cutters 40A' in particular, define gage 24 of drill bit 10G and if an imaginary gage line 25 were drawn generally parallel to gage pads 30A and 30B there would preferably be a gap 37 between the outermost gage-facing surface of gage pad 30A and 30B as gage cutter 40A' or gage cutter 40B', as appropriate, due to gage cutters 40A' and 40B' being circumferentially positioned to have respective preselected extension distances 48A, 48B as shown in FIG. 22. That is, preferably radial extension distance 48A will be greater than 48B as gage cutters 40A' will be more aggressive than gage cutters 40B', assuming gage cutters 40A' and 40B' have approximately the same size, cutter surface shape, back and side rakes, and utilize essentially the same superabrasive material on tables 58. Thus, gage cutters 40A' will preferably extend a greater distance away from longitudinal centerline 26 of drill bit 10G than does gage cutter 40B' to provide the desired differing degree of aggressivity. Of course, the amount or degree of aggressivity of gage cutters 40A' and 40B' can be selectively altered by changing one or more aggressivity influencing characteristics as previously described with respect to gage pad mounted gage cutters 40A and 40B. Moreover, the relative degree of aggressivity of gage cutters 40A' and 40B' are and can be regarded as being influenced by the distance in which the radially distant most portion of cutters 40A and 40B extend beyond the radially outermost gage-facing surface of its associated gage pad 30A, 30B whether or not such gage pads have cutters or cutting elements mounted directly thereon, such as drill bit 10G'.

It will now be apparent that relatively more aggressive gage pads 30A and relatively less aggressive gage pads 30B need not have cutters mounted directly thereon to practice the present invention, as alternative gage cutters can be mounted circumferentially and longitudinally proximate to such gage pads, preferably slightly longitudinally below and along the leading edge of such gage pads, and still provide the desired degree of aggressivity of gage, or side, cutting ability. Furthermore, although gage cutters 40A' and 40B' are shown as having fully-circular cutter surfaces 60A' and 60B' and cutter substrates 62A' and 62B', such can be ground, or trimmed, provided the trimmed surface extends a sufficient radial distance from the centerline of the drill bit, or alternatively from the radially outermost gage-facing surface of the respectively associated gage pad, to aggressively engage the formation in accordance with the present invention.

Figure 6C:
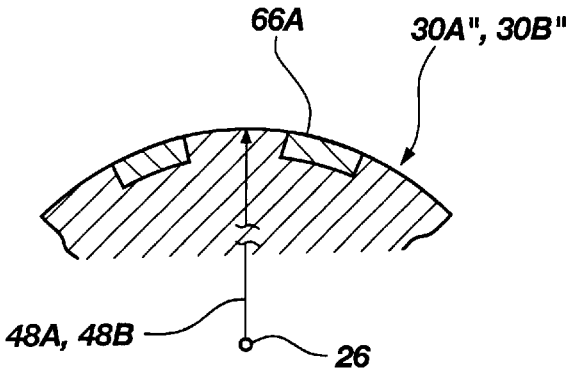
FIG. 6C is truncated cross-sectional view as taken along line 6C—6C of the gage pad shown in FIG. 6A with the TCI compacts being flush mounted in the radially outward-facing surface of an exemplary gage pad which are particulary suitable for use in connection with alternative embodiments of the present invention such as the exemplary alternative embodiments shown in FIGS. 21A–22.
Figure 7C:
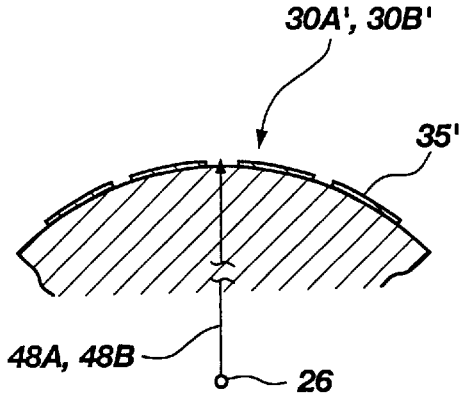
FIG. 7C is truncated cross-sectional view as taken along line 7C—7C of the gage pad shown in FIG. 7A with the abrasive/hardfacing material disposed on the radially outward-facing surface of a gage pad so as to be essentially or nearly flush with the radially outward-facing surface of an exemplary gage pad which are particulary suitable for use in connection with alternative embodiments of the present invention such as the exemplary alternative embodiments shown in FIGS. 20A through 22.

It should further be understood that, although drill bit 10G as shown in FIGS. 20A, 21A, and 22 is shown as not having gage cutters, or gage cutting elements mounted directly on gage pads 30A and 30B, and alternative drill bit 10G' is shown as having alternative gage cutters 40A' and 40B' combined with exemplary cutting TCI brick type cutters 66B at least partially embedded therein, a wide variety of combinations comprising a wide variety of different types of cutters cutting elements, such as but not limited to the exemplary cutting elements arranged in various patterns as shown in the previous FIGS. of the drawings can utilized to gain the benefits and advantages of the present invention. For example, as shown in FIG. 21C a drill bit 10G" is provided with a plurality of circumferentially spaced alternative gage pads 30A" and 30B" wherein gage pad 30A" is provided with an outermost gage-facing surface shown as being at least partially covered by regions of hardfacing material 35 described earlier and illustrated in FIG. 1 and FIGS. 7A and 7B of the drawings. However in the embodiment of the present invention shown in FIG. 21C, hardfacing material 35 is nearly or essentially flush with the radial outermost facing surface of gage pad 30A" and as is illustrated in FIG. 7C. That is, hardfacing material 35 does not protrude a significant distance beyond the outermost gage-facing surface of gage pad 30A" and generally provides an anti-wear surface and generally does not aggressively engage the formation upon drill bit 10G" being placed in service. Gage pad 30B" as depicted in FIG. 21C is shown as having TCI brick-shaped compacts 66B being flush-mounted on the outermost gage-facing surface of gage pad 30B". A representative cross-sectional view of TCI brick-shaped compacts being flush-mounted so as not to extend substantially beyond the outermost gage-facing surface of a representative gage pad 30B" is provided in FIG. 11C of the drawings. It should be understood that any of the described and depicted cutting elements and the like can be disposed on selected gage pads in flush-mounted manner in accordance with the present invention and that gage pads 30A" having hardfacing 35 and gage pads 30B" having TCI brick-shaped compacts flush mounted thereon are intended to be exemplary. For example, FIG. 6C depicts the flush mounting of larger diameter TCI compacts 66A in a representative gage pads 30A"/30B' and FIG. 10C depicts the flush mounting of rounded TCI compacts 66D in representative gage pads 30A"/30B". Furthermore, it should be appreciated that the flush mounting of cutting elements whether TCI compacts, other abrasive materials such as diamonds, or hardfacing material, in gage pads in accordance with the present invention need not be limited to the exemplary arrangements, or patterns, discussed and illustrated in the referenced drawings. For example the entire outermost gage-facing surface of a gage pad could be covered with hardfacing 35 to render a desired degree of aggressiveness or alternatively to render a desired degree of wear-resistance.

Figure 23:
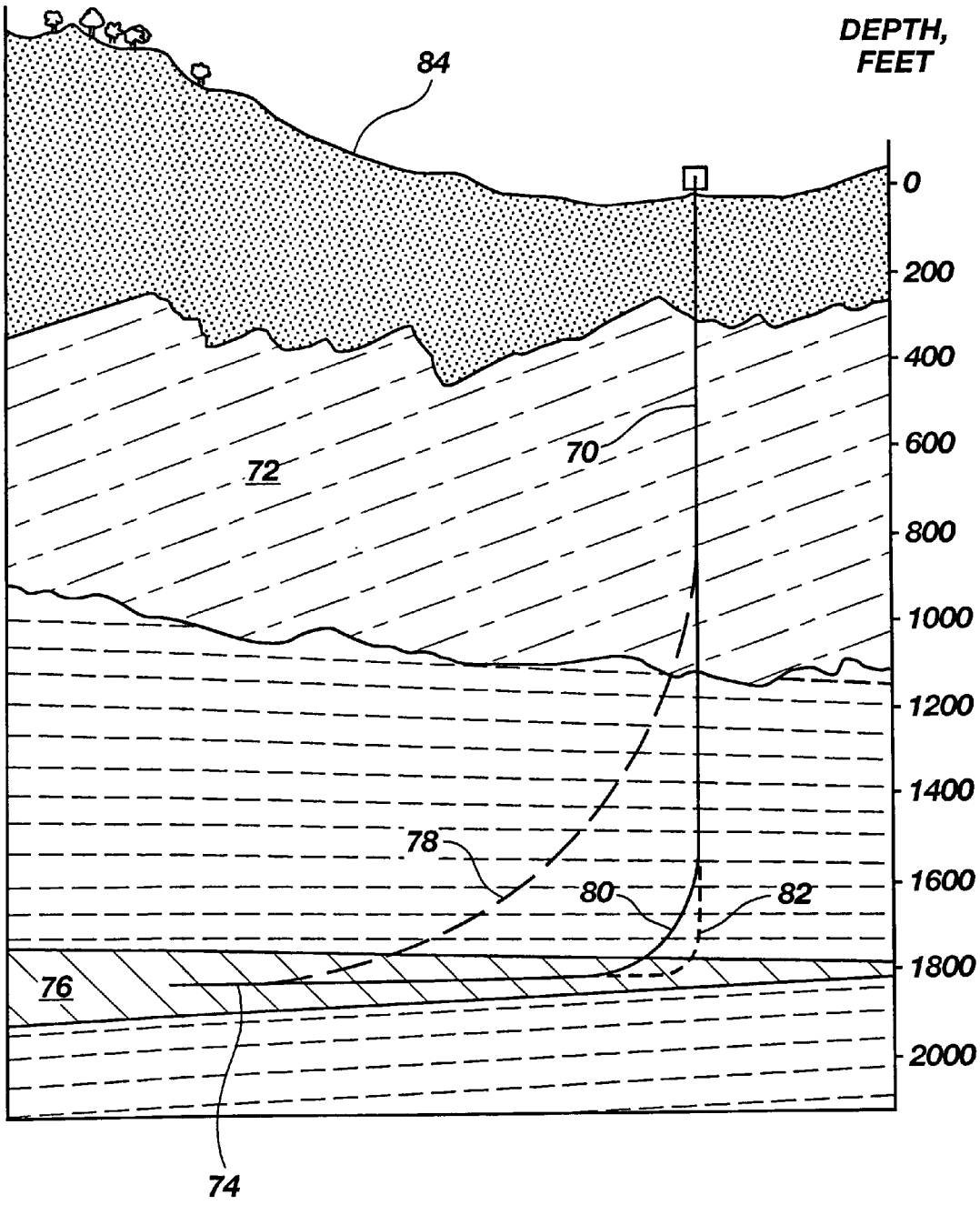
FIG. 23 is an exemplary cross-sectional side view through a subterranean formation depicting deviated, or horizontal, bore holes with comparatively long, medium and short radii of curvature.

Turning now to the aspect of drilling deviated bore holes in earthen formations in accordance with the present invention, FIG. 23 provides a view of a generally vertical bore hole 70 drilled from the earth surface 84 into a formation 72 to culminate in a generally horizontal reach 74 within a particular rock formation layer 76. As generally defined, the ability of a drill bit to deviate from a linear path may be defined by its potential radius of curvature. FIG. 3 illustrates a long radius curve 78 of radius about 1000 feet (about 305 meters), a medium radius curve 80 of radius about 300 feet (about 91 meters), and a short radius curve 82 of radius about 100 feet (about 30.5 meters).

It can be seen that, that under certain conditions, such as when the targeted formation layer 76 is generally perpendicular to the vertical bore hole 70, it is generally preferred to drill a bore hole with a short radius of curvature 82 so as to maximize the extent in which the non-vertical, horizontal reach 74 of the bore hole extends through the targeted formation layer 76. Furthermore, for a given amount of angular error, a short radius of curvature would not so like "miss" the targeted formation layer 76 as compared to making the same angular error if drilling a medium radiused curved bore hole 80 or a long radiused curved bore hole 78, which if great enough, could result in essentially "diving vertically through" the targeted formation layer 76. Thus, it is usually desirable when feasible, to use a short radius curved bore hole 82 to produce an optimal non-vertical, horizontal reach 74 in the targeting of a generally horizontally oriented formation at a given vertical depth.

Regardless of the particular configuration of the cutting face 18, the use of various cutting elements on, or in association with, gage pads 30A, 30B, and the diverse and various alternatives thereof, in order to provide gage pads with differing amounts, or levels, of total, over all, aggressiveness in a preselected circumferential pattern as described herein, provides a controllable and customizable degree of side-cutting which is particularly advantageous for achieving minimum-radius curved bore holes with a minimum of undesired wandering from the preselected trajectory while at the same time offering enhanced resistance to drill bit deterioration while also maintaining to a preselected extent, the amount of lateral force to be transmitted by each of the gage pads to provide bit stabilization, constant or near constant bore hole geometry, and bore hole surface quality.

Thus, it is to be understood and appreciated by those skilled in the art that the present invention as defined by the following claims is not to be limited by the particular embodiments set forth in the above detailed description as many variations thereof are possible without departing from the spirit and scope of the present invention as claimed.

What is claimed is:

1. A rotary drill bit for drilling a subterranean formation, comprising:

a bit body having a face, a gage, a shank, and a central longitudinal axis;

at least one cutting structure disposed on the face of the bit body;

the bit body having a plurality of circumferentially spaced gage pads, each of the gage pads comprising an aggressive, generally radially outermost gage-facing surface;

at least one gage pad of the plurality being configured for relatively more aggressive gage-cutting; and at least one gage pad of the plurality being configured for relatively less aggressive gage-cutting.

2. The rotary drill bit of claim 1, wherein:

the at least one gage pad configured for relatively more aggressive gage-cutting includes at least one cutting element having a relatively high degree of aggressiveness disposed on the generally radially outermost gage-facing surface thereof; and wherein the at least one gage pad configured for relatively less aggressive gage-cutting includes at least one cutting element having a relatively low degree of aggressiveness disposed on the generally radially outermost gage-facing surface thereof.

3. The rotary drill bit of claim 2, wherein the at least one cutting element having a relatively high degree of aggressiveness is at least partially embedded within and extends a first preselected radial distance from the generally radially outermost gage-facing surface of the at least one gage pad configured for relatively more aggressive gage-cutting.

4. The rotary drill bit of claim 3, wherein the at least one cutting element having a relatively low degree of aggressiveness is at least partially embedded within and extends a second preselected radial distance from the generally radially outermost gage-facing surface of the at least one gage pad configured for relatively less aggressive gage-cutting and wherein the second preselected radial distance is less than the first preselected radial distance.

5. The rotary drill bit of claim 2, wherein the at least one cutting element having a relatively high degree of aggressiveness comprises a first superabrasive material and the at least one cutting element having a relatively low degree of aggressiveness comprises a second superabrasive material, and wherein the first material is harder than the second material.

6. The rotary drill bit of claim 2, wherein the at least one cutting element having a relatively high degree of aggressiveness extends a first maximum radial distance from the central longitudinal axis of the bit body and the at least one cutting element having a relatively low degree of aggressiveness extends a second maximum radial distance from the central longitudinal axis, and further wherein the first maximum radial distance is greater than the second maximum radial distance.

7. The rotary drill bit of claim 2, wherein the at least one cutting element having a relatively high degree of aggressiveness comprises exposed edges and the at least one cutting element having a relatively low degree of aggressiveness comprises exposed edges which are generally less sharp than the exposed edges of the at least one cutting element having a relatively high degree of aggressiveness.

8. The rotary drill bit of claim 2, wherein:

the at least one cutting element having a relatively high degree of aggressiveness and the at least one cutting element having a relatively low degree of aggressiveness each comprise at least one member of the group comprising natural diamonds, synthetic diamonds, tungsten carbide inserts, polycrystalline diamond compacts, cubic boron nitride compacts, thermally stable products, and hard facing compositions.

9. The rotary drill bit of claim 2, wherein the at least one cutting element having a high degree of aggressiveness and the at least one cutting element having a low degree of aggressiveness each respectively comprise a plurality of cutting elements respectively formed of a preselected superabrasive material and wherein each respective plurality of cutting elements is arranged in a preselected pattern on the generally radially outermost gage-facing surface of its respective gage pad.

10. The rotary drill bit of claim 2, wherein the at least one cutting element having a relatively high degree of aggressiveness and the at least one cutting element having a relatively low degree of aggressiveness each comprise diamonds.

11. The rotary drill bit of claim 2, wherein the at least one cutting element having a relatively high degree of aggressiveness comprises at least one polycrystalline diamond compact cutter having a backrake not exceeding approximately zero degrees (0°) and the at least one cutting element having a relatively low degree of aggressiveness comprises a plurality of generally radiused tungsten carbide inserts.

12. The rotary drill bit of claim 2, wherein at least one of the group comprising the at least one cutting element having a relatively high degree of aggressiveness and the at least one cutting element having a relatively low degree of aggressiveness comprises at least one tungsten carbide insert of a preselected size, shape, and orientation.

13. The rotary drill bit of claim 2, wherein at least one of the group comprising the at least one cutting element having a relatively high degree of aggressiveness and the at least one cutting element having a relatively low degree of aggressiveness comprises particles of thermally stable product of at least one preselected size and orientation.

14. The rotary drill bit of claim 2, wherein at least one of the group comprising the at least one cutting element having a relatively high degree of aggressiveness and the at least one cutting element having a relatively low degree of aggressiveness comprises a combination of a plurality of individual cutting elements having at least one cutting surface comprising a preselected superabrasive material and the individual cutting elements being arranged in a preselected pattern.

15. The rotary drill bit of claim 14, wherein each of the plurality of individual cutting elements includes cutting surfaces selected from the group comprising natural diamonds, synthetic diamonds, tungsten carbide inserts, polycrystalline diamond compacts, cubic boron nitride compacts, and thermally stable polycrystalline diamond compacts.

16. The rotary drill bit of claim 14, wherein the at least one cutting surface of a majority of the plurality of individual cutting elements having a relatively high degree of aggressiveness extends a greater radial distance from the central longitudinal axis of the bit body than the at least one cutting surface of a majority of the plurality of individual cutting elements having a relatively low degree of aggressiveness.

17. The rotary drill bit of claim 14, wherein the at least one cutting surface of a majority of the plurality of individual cutting elements having a relatively high degree of aggressiveness extends a greater radial distance from the generally radially outermost gage-facing surface of its respective gage pad than does the at least one cutting surface of a majority of the plurality of individual cutting elements having a relatively low degree of aggressiveness.

18. The rotary drill bit of claim 2, wherein the at least one cutting element having a relatively high degree of aggressiveness comprises at least one polycrystalline diamond compact cutter, or cubic boron nitride cutter, of a preselected shape and size, and having a preselected backrake angle and the at least one cutting element having a relatively low degree of aggressiveness comprises at least one polycrystalline diamond compact cutter, or cubic boron nitride cutter, of a preselected shape and size, and having a preselected backrake angle that is more negative than the preselected backrake angle of the at least one cutting element having a relatively high degree of aggressiveness.

19. The rotary drill bit of claim 18, wherein the at least one cutting element having a relatively high degree of aggressiveness comprises a plurality of polycrystalline diamond compact cutters, each generally having a first preselected backrake angle, and wherein the at least one cutting element having a relatively low degree of aggressiveness comprises a plurality of polycrystalline diamond compact cutters, each having a preselected negative backrake angle more negative than the first preselected backrake angle.

20. The rotary drill bit of claim 2, wherein each of the plurality of gage pads includes at least one gage-defining cutting element having a preselected degree of aggressiveness and being respectively positioned most longitudinally proximate and most circumferentially aligned with each of the plurality of gage pads so as to be exclusively associated therewith, at least a portion of each of the gage-defining cutting elements being positioned at a radial distance from the central longitudinal axis of the bit body which is greater than a preselected radial distance of the generally radially outermost gage-facing surface of its exclusively related gage pad; and wherein at least one of the gage-defining cutting elements exclusively associated with at least one of the gage pads has a relatively higher degree of aggressiveness than at least one of the remaining gage cutting elements exclusively associated with at least one of the other circumferentially spaced gage pads.

21. The rotary drill bit of claim 1, wherein the at least one gage pad configured for more aggressive gage-cutting comprises a plurality of relatively more aggressive gage pads;

the at least one gage pad configured for less aggressive gage-cutting comprises a plurality of relatively less aggressive gage pads; and the plurality of relatively more aggressive gage pads and the plurality of relatively less aggressive gage pads are circumferentially arranged in a preselected alternating pattern.

22. The rotary drill bit of claim 21, wherein the preselected alternating pattern comprises an equal number of relatively more aggressive gage pads and relatively less aggressive gage pads.

23. The rotary drill bit of claim 21, wherein the preselected alternating pattern comprises every other circumferentially spaced gage pad being a relatively more aggressive gage pad.

24. The rotary drill bit of claim 21, wherein the preselected alternating pattern comprises at least two of the plurality of relatively more aggressive gage pads being proximate and circumferentially adjacent each other.

25. The rotary drill bit of claim 21, wherein the preselected alternating pattern comprises at least two of the plurality of relatively less aggressive gage pads being proximate and circumferentially adjacent each other.

26. The rotary drill bit of claim 21, wherein the preselected alternating pattern comprises at least two of the plurality of relatively more aggressive gage pads being proximate and circumferentially adjacent each other and at least two of the plurality of relatively less aggressive gage pads being proximate and circumferentially adjacent each other.

27. The rotary drill bit of claim 1, wherein the generally radially outermost gage-facing surface of at least one of the at least one gage pad configured for relatively more aggressive gage-cutting and the at least one gage pad configured for relatively less aggressive gage-cutting comprises at least one raised portion and wherein at least the at least one raised portion of the generally radially outermost gage-facing surface comprises superabrasive particles.

28. The rotary drill bit of claim 27, wherein the at least one raised portion comprises a plurality of raised portions and a plurality of intervening recesses and wherein the superabrasive particles are selected from the group comprising natural diamonds and synthetic diamonds.

29. The rotary drill bit of claim 1, wherein the generally radially outermost gage-facing surface of at least one of the at least one gage pad configured for more aggressive gage-cutting and the at least one gage pad configured for less aggressive gage-cutting comprises at least one raised portion and wherein at least the at least one raised portion of the radially outermost gage-facing surface comprises a preselected hard facing composition disposed thereon.

30. A rotary drill bit for drilling a subterranean formation, comprising:

a bit body having a face, a gage, a shank, and a central longitudinal axis;

at least one cutting structure disposed on the face of the bit body;

the bit body having a plurality of circumferentially spaced gage pads positioned longitudinally intermediate the face and the shank of the bit body, each gage pad having a generally radially outermost gage-facing surface positioned at a preselected radial distance from the central longitudinal axis;

wherein each of the plurality of gage pads includes at least one most-proximately positioned gage-defining off-gage pad cutting element having a preselected degree of aggressiveness and being respectively positioned to be most longitudinally proximate and most circumferentially aligned with each of the plurality of gage pads so as to be exclusively associated therewith, at least a portion of each of the gage-defining off-gage pad cutting elements being positioned at a greater radial distance from the central longitudinal axis of the bit body than the preselected radial distance of the generally radially outermost gage-facing surface of its exclusively related gage pad; and wherein at least one of the off-gage pad cutting elements exclusively associated with one of the circumferentially spaced gage pads has a relatively higher degree of aggressiveness than at least one of the remaining off-gage pad cutting elements exclusively associated with at least one of the other circumferentially spaced gage pads.

31. The rotary drill bit of claim 30, wherein each of the off-gage pad cutting elements comprises at least one superabrasive material selected from the group comprising natural diamonds, synthetic diamonds, tungsten carbide inserts, polycrystalline diamond compacts, cubic boron nitride compacts, and thermally stable product.

32. The rotary drill bit of claim 30, wherein each of the off-gage pad cutting elements and exclusively associated gage pads being positioned in a preselected alternating circumferential pattern based upon the preselected degree of aggressiveness of each off-gage pad cutting element.

33. The rotary drill bit of claim 30, wherein each of the off-gage pad cutting elements is a polycrystalline diamond compact cutter having a preselected backrake angle.

34. The rotary drill bit of claim 33, wherein each of polycrystalline diamond compact off-gage pad cutters includes a generally circular, nontruncated cutting surface.

35. The rotary drill bit of claim 33, wherein a preselected number of the polycrystalline diamond compact off-gage pad cutters have a relatively high degree of aggressiveness and a remaining number of the polycrystalline compact off-gage pad cutters have a relatively low degree of aggressiveness.

36. The rotary drill bit of claim 33, wherein the polycrystalline diamond compact off-gage pad cutters having a relatively high degree of aggressiveness have backrake angles being less negative than backrake angles of the polycrystalline diamond compact off-gage pad cutters having a relatively low degree of aggressiveness.

37. The rotary drill bit of claim 30, wherein at least one of the plurality of circumferentially spaced gage pads includes at least one on-gage pad cutting element having a relatively high degree of aggressiveness disposed on the generally radially outermost gage-facing surface thereof;

and at least one of remaining circumferentially spaced gage pads includes at least one on-gage pad cutting element having a low degree of aggressiveness.

38. The rotary drill bit of claim 37, wherein the at least one on-gage pad cutting element having relatively high degree of aggressiveness is at least partially embedded within and extends a first preselected radial distance from the generally radially outermost gage-facing surface of the at least one circumferentially spaced gage pad.

39. The rotary drill bit of claim 38, wherein the at least one on-gage pad cutting element having a relatively low degree of aggressiveness extends a second preselected distance from the generally radially outermost gage-facing surface of the at least one remaining circumferentially spaced gage pad and wherein the second preselected radial distance is less than the first preselected radial distance.

40. The rotary drill bit of claim 37, wherein the at least one on-gage pad cutting element having a relatively high degree of aggressiveness comprises a first abrasive material and the at least one on-gage pad cutting element having a relatively low degree of aggressiveness comprises a second abrasive material, and wherein the first material is harder than the second material.

41. The rotary drill bit of claim 37, wherein the at least one on-gage pad cutting element having a relatively high degree of aggressiveness extends a first maximum radial distance from the central longitudinal axis of the bit body and the at least one on-gage pad cutting element having a relatively low degree of aggressiveness extends a second maximum radial distance from the central longitudinal axis of the bit body and wherein the first maximum radial distance is greater than the second maximum radial distance.

42. The rotary drill bit of claim 37, wherein the at least one on-gage pad cutting element having a relatively high degree of aggressiveness comprises exposed edges and the at least one on-gage pad cutting element having a relatively low degree of aggressiveness comprises exposed edges which are generally less sharp than the exposed edges of the at least one on-gage pad cutting element having a relatively high degree of aggressiveness.

43. The rotary drill bit of claim 37, wherein the at least one on-gage pad cutting element having a relatively high degree of aggressiveness and the at least one on-gage pad cutting element having a relatively low degree of aggressiveness each comprise at least one member of the group comprising natural diamonds, synthetic diamonds, tungsten carbide inserts, polycrystalline diamond compacts, cubic boron nitride compacts, thermally stable products, and hard facing compositions.

44. The rotary drill bit of claim 37, wherein the at least one on-gage pad cutting element having a high degree of aggressiveness and the at least one on-gage pad cutting element having a low degree of aggressiveness each respectively comprise a plurality of additional on-gage pad cutting elements formed of a preselected superabrasive material arranged in a preselected pattern.

45. The rotary drill bit of claim 37, wherein the generally outermost gage-facing surface of at least one circumferentially spaced gage pad of the plurality comprises at least one raised portion and wherein at least the at least one raised portion of the surface comprises superabrasive particles.

46. The rotary drill bit of claim 45, wherein the at least one raised portion comprises a plurality of raised portions and a plurality of intervening recesses and wherein the superabrasive particles are selected from the group comprising natural diamonds and synthetic diamonds.

47. The rotary drill bit of claim 37, wherein the generally radially outermost gage-facing surface of at least one circumferentially spaced gage pad of the plurality comprises at least one raised portion and wherein at least the at least one raised portion comprises a preselected hard facing composition disposed thereon.

48. The rotary drill bit of claim 37, wherein at least one of the at least one on-gage pad cutting element having a relatively high degree of aggressiveness and the at least one cutting element having a relatively low degree of aggressiveness comprises a plurality of different types of individual on-gage pad cutting elements arranged in a preselected pattern and respectively having at least one cutting surface comprising a preselected superabrasive material.

49. The rotary drill bit of claim 48, wherein each of the plurality of different types of on-gage pad cutting elements have respective cutting surfaces selected from the group comprising natural diamonds, synthetic diamonds, tungsten carbide inserts, polycrystalline diamond compacts, cubic boron nitride compacts, and thermally stable polycrystalline diamond compacts.

50. The rotary drill bit of claim 49, wherein the respective cutting surfaces of a majority of the plurality of different types of on-gage pad cutting elements including a relatively high degree of aggressiveness and extend a greater radial distance from the central longitudinal axis of the bit body than the at least one cutting surface of a majority of the plurality of individual cutting elements having a relatively low degree of aggressiveness.

* * * * *

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Title page, Item [54], and Column 1, line 2,
Title, change "SELECTIVELY-AGGRESSIVE" to -- SELECTIVELY AGGRESSIVE --

Column 1,
Line 30, after "of" and before "substantially" insert -- a --
Line 38, insert a comma after "extending"
Line 44, change "have" to -- has --
Line 50, delete the comma after "face"
Line 53, insert a comma after "pressure"
Line 59, change "above described" to -- above-described --
Line 62, change "the cutting element cuts" to -- these cutters cut --
Line 64, insert a comma after "is"
Line 66, change "further-most" to -- furthermost --

Column 2,
Line 4, change "above described" to -- above-described --
Line 14, insert a comma after "raised"
Line 18, change "that" to -- where --
Line 30, change "relative" to -- relatively --
Line 32, change "unuseable" to -- unusable --
Line 39, change "extended reach" to -- extended-reach --
Line 42, delete the comma after "formation" and insert a comma after "zone"
Line 44, delete the comma after "degrees"
Line 48, before "such" delete "a"
Line 62, delete the comma after "quality"

Column 3,
Line 4, insert a comma after "degrees"
Line 5, change "foot" to -- feet --
Line 13, insert a comma after "i.e."
Line 14, delete "as"
Line 19, after "the" and before "associated" insert -- correspondingly smaller the --
Line 20, delete "is"
Line 21, delete "correspondingly smaller"
Line 22, change "pre-determined" to -- predetermined --
Line 33, before "some" delete "with"
Line 42, delete "in accordance"
Line 43, delete "with the ‘524 Newton et al. patent"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 3 (cont'd),
Line 48, insert a comma after "blades"
Line 59, delete "having"
Line 60, delete "properties"

Column 4,
Line 2, insert a comma after "that" and delete "upon" and change "drilled, it" to -- drilled --
Line 5, change "smoothness, or in" to -- smoothness. In --
Line 21, delete "which"
Line 27, insert a comma after "on"
Lines 29 and 32, insert a comma after "or"
Line 36, delete a comma after "widely"
Line 42, change "number" delete "of"
Line 45, change "is" to -- are --
Line 50, before "minimum" delete "a"
Lines 50 and 52, before "maximum" delete "a"
Lines 50-51, change "non-productive" to -- nonproductive --
Line 53, before "minimal" insert -- and --
Line 55, before "thus" delete "and" and change "over all" to -- overall --
Line 57, delete the comma after "embodying"
Lines 60-61, change "above identified" to -- above-identified --
Line 63, change "DRAWING" to -- DRAWINGS --
Line 65, delete the comma after "invention"

Column 5,
Line 22, delete "outward-"
Line 23, change "facing" to -- outwardly facing --
Line 25, insert a comma after "(TCIs)"
Lines 29 and 42, after "is" and before "truncated" insert -- a --
Lines 31, 36-37, 45 and 46, change "outward-facing" to -- outwardly facing --
Line 32, after "pad" and before "which" insert -- and -- and change "particulary" to -- particularly --
Line 38, insert a comma after "aggressive"
Line 42, after "is" and before "truncated" insert -- a --
Line 47, after "pad" insert -- and -- and change "are particulary" to -- is particularly --

Column 6,
Lines 2 and 9, insert a comma after "smooth"
Line 6, after "is" and before "truncated" insert -- a --
Lines 10 and 24, change "outward-facing" to -- outwardly facing --
Lines 11 and 25, after "pad" and before "which" insert -- and --

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 6 (cont'd),
Line 37, insert a comma after "aggressive"
Line 39, change "sectional" to -- cross-sectional --
Line 56, insert a comma after "pads"

Column 7,
Lines 8 and 16, change the comma after "axis" to a semicolon and insert a comma after "particular"
Line 20, insert a comma after "manner"
Line 25, change "20A, however" to -- 20A; however, --
Line 28, insert a semicolon after "pads" and thereafter begin a new paragraph with "FIG. 21A"
Line 30, before "off-gage" change "a" to -- an --
Lines 37 and 40, change "relative" to -- relatively --
Lines 38 and 41, change "are" to -- is -- and change "protrude" to -- protrudes --
Line 47, change "and wherein" to -- with --
Line 48, change "have" to -- has --
Line 52, change "has" to -- have --

Column 8,
Line 15, insert a comma after "of"
Line 20, delete the comma after "path"
Line 28, after "operation" and before "will" insert -- but --
Line 33, change "radially-directed" to -- radially directed, --
Line 44, delete "particular"
Line 45, change "particulary" to -- particularly --
Line 48, delete the comma after "use"
Line 49, insert a comma after "and"
Line 50, change "Cutting" to -- Superabrasive --
Line 56, insert a comma after "e.g."

Column 9,
Line 13, change "2. Gage" to -- 2, gage --
Line 21, change "35A and " to -- 35 --
Line 22, delete "35B"
Line 24, insert a comma after "elements"
Line 34, change "every other" to -- every-other --
Line 37, insert a comma after "is"
Line 45, delete "being" and change "in raised portions of gage pads 30B" to -- therein --
Lines 47 and 62, delete the comma after "30B"
Line 50, change "10B" to -- 10A --
Line 53, delete the comma after "30B" and insert a comma after "include"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 9 (cont'd),
Line 56, insert a comma after "Furthermore"
Line 59, insert a comma after "is" and delete the comma after "portion"
Line 60, change "outward" to -- outwardly --
Line 65, after "generally" insert -- the less aggressive --
Line 66, delete "less aggressive"

Column 10,
Line 3, insert a comma after "exposed"
Line 6, change "relatively" to -- relative --
Line 7, after "gage" delete "pads"
Line 8, delete "30A and 30B, the degree of aggressiveness between the"
Line 9, delete "cutting element provided on"
Line 11, before "pads" insert -- gage --
Line 26, delete the comma after "30B"
Line 28, change "of each raised portion" to -- thereof --
Line 48, change "34A" to -- 30A --
Line 49, change "34B" to -- 30B --
Line 52, change "pad" to -- pads --
Line 53, after "in" and before "7B" insert -- FIG. --
Line 57, change "particulary" to -- particularly --
Line 63, delete "oriented to be"
Line 65, delete "oriented to be" and change "cris-crossed" to -- criss-crossed --

Column 11,
Line 1, change "10" to -- 10A --
Lines 5 and 7, change "10" to -- 10A and 10B --
Line 9, change "above mentioned" to -- above-mentioned --
Line 11, delete the comma after "therein"
Line 15, insert a comma after "i.e."
Line 19, change "portion" to -- portions --
Line 20, before "shape" insert -- the --
Line 25, delete "each"
Line 30, change "drawings. In" to -- drawings, in --
Line 33, change "40" to -- 40A, 40B --
Line 35, change "As" to -- as --
Line 38, change "10." to -- 10B. --
Line 41, change "non-connected" to -- nonconnected --
Line 42, change "non-aligned" to -- nonaligned --
Line 53, before "polycrystalline" insert -- or --
Line 55, insert a comma after "30B"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 12,
Lines 9 and 10, before "pads" insert -- gage --
Line 11, insert a comma after "that"; insert a comma after "desired"; and change "10" to -- 10B --
Line 13, delete the comma after "trajectory"
Lines 14, 15 and 21, change "wellbore" to -- well bore --
Line 28, delete the comma after "30B"
Line 30, change "10" to -- 10A --
Line 35, insert a comma after -- i.e. --
Line 38, before "shape" insert -- the --
Line 39, delete the comma after "elements"; change "40" to -- 40A, 40B -- ; insert a comma after "e.g."; and at the end of the line delete "or"
Line 40, change "and" to -- the --
Line 41, change "40;" to -- 40A, 40B; the --
Line 44, change "could have" to -- having --
Line 48, insert a comma after "i.e."
Line 49, change the semicolon after "edges" to a comma
Line 50, insert a comma after "i.e."
Line 51, after "72" insert -- (FIG. 5) --
Line 52, insert a comma after "provide"
Line 56, insert a comma after "invention"
Line 64, delete the comma after "understood" and insert a comma after "that"

Column 13,
Line 2, after "may" insert -- be -- and after "essentially" delete "be"
Lines 4 and 15, change "40" to -- 40A, 40B --
Line 6, delete the comma after "pad"
Line 18, after "86" change "of" to -- is --
Line 22, delete the comma after "40B"
Line 25, change "62" to -- 62A, 62B (see FIG. 3) --
Lines 34 and 35, change "radius" to -- extension distance --
Line 39, change "68" to -- 68A, 68B --
Line 39, before "which" delete "in"
Line 39, before "distance" insert -- radial --
Line 42, after "or" and before "associated" insert -- with which it is -- and after "associated" delete "with"
Line 43, after "aggressiveness" insert -- of --
Line 43, delete the comma after "cutter"
Line 44, delete the comma after "have"
Line 48, delete the comma after "4"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 13 (cont'd),
Line 50, insert a comma after "e.g."
Line 56, change "6A" to -- 6A, 6B and 8A --
Line 60, after "accordance" change "of" to -- with --
Line 62, after "most" change "edge" to -- edges --
Line 67, change "cylindrically-shaped" to -- cylindrically shaped --

Column 14,
Line 5, delete "as depicted,"
Line 12, change "depicting" to -- depict --
Line 13, change "31A" to -- 31A' --
Line 15, change "35" to -- 35' --
Line 22, change "rectangularly-shaped" to -- rectangularly shaped -- and delete the comma after "66B"
Line 24, delete the comma after "particles"
Lines 30-31, change "diamonds" to -- diamond particles or chips --
Line 32, change "extend" to -- extends --
Line 36, delete the comma after "66D"
Line 38, change "are" to -- is --
Line 39, delete the comma after "compacts"
Line 41, delete the comma after "vertically"

Column 15,
Line 10, delete the comma after "40A"
Line 18, insert a comma after "speaking"
Line 20, change "mounted," to -- mounted a -
Line 22, insert a comma after "understood"
Line 23, insert a comma after "with"
Line 26, insert a comma after "is"
Line 28, delete the comma after "pad"
Line 38, before "edge" delete "the"
Line 51, change "size" to -- sizes --
Line 56, delete the comma after "disposed"
Line 64, insert a comma after "Again"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 16,
Line 2, delete the comma after "thereon"
Line 6, delete the comma after "partially"
Line 10, change "relative" to -- relatively --
Line 12, at the beginning of the line, delete "having"
Line 13, insert a comma after "basis"
Line 15, delete "TCI compact provided to", delete "a"
Line 16, delete "have"
Line 17, delete "having"
Line 25, after "protrusion," insert -- having -- and change "relative" to -- relatively --
Line 26, before "relatively" insert -- a --
Lines 28-29, change "oval shaped" to -- oval-shaped --
Line 29, change "66C" to -- 66D --
Line 30, change "compact, could" to -- compact could, --
Line 32, delete the comma after "area"
Line 36, before "shown" change "are" to -- is --
Line 40, before "there" delete "that"
Line 43, change "type or more" to -- or more types --
Line 45, insert a comma after "guidelines"
Line 55, change "now being" to -- is-now --
Line 56, after "18" and before "respectively" insert -- which -- and change "illustrating" to -- illustrate --
Line 58, delete "being"
Line 65, insert a comma after "is"

Column 17,
Line 4, insert a comma after "pattern" and delete "and which are"
Line 6, before "oriented" delete "are"
Lines 13 and 20, change "66B" to -- 66A --
Line 16, after "TCI" and before "compacts" insert -- bricks, or -- and change "66B" to -- 66A --
Line 36, change "30"" to -- 30A" --
Lines 38 and 41, change "31A" to -- 31B --
Line 42, change "abrasive" to -- aggressive --
Line 45, before "disposed" insert -- (not shown) --
Line 46, delete the comma after "Although"
Line 48, after "to" and before "preselected" insert -- a --
Line 49, insert a comma after "that"
Line 53, insert a comma after "can" and insert a comma after "instances"
Line 56, change the comma after "34" to a semicolon and insert a comma after "however"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 17 (cont'd),
Line 59, after "As" and before "drill" insert -- with -- and change "are" to -- is --
Line 60, insert a comma after "alternating"
Line 61, after "particles" insert -- 66C --
Line 65, insert a comma after "intervening"
Line 66, change "66C" to -- 66A --

Column 18,
Line 7, insert a comma after "is" change "pads" to -- pad surfaces --
Line 12, insert a comma after "whereas"
Line 16, delete the comma after "opposite" and delete the comma after "side"
Line 25, change "show" to -- shown --
Line 26, before "less" insert -- and --
Line 29, at the end of the line, after "aggressive" insert -- gage --
Line 43, change "lower most" to -- lowermost --
Line 46, delete the comma after "100"
Line 48, after "gage" and before "125" insert -- -line --
Line 51, delete the comma after "non-symmetrical"
Line 53, delete the comma after "100"
Line 62, change "will determine" to -- determining --
Line 65, insert a comma after "formation"

Column 19,
Line 2, change "drill" to -- drilled -- and insert a comma after "progresses"
Line 5, change "radial" to -- radially --
Line 5, change "outmost-facing" to -- outermost-facing --
Line 18, after "gage" insert -- 124 --
Line 24, delete "depending on"
Line 26, change "has," to -- is to have -- and change " above is" to -- above, will be --
Line 29, change "time honored" to -- time-honored -- and delete the comma after "art"
Line 30, insert a comma after "121""
Line 32, delete "each of the subject cutters"
Line 36, delete the comma after "with"
Line 42, delete the comma after "sense"
Line 48, after "drawings" and before "is" insert -- ,but --
Line 52, change "on the gage pad" to -- thereon --
Line 57, change "being" to -- is --; delete "20B,"; and delete "21B,"
Line 59, after "21B," and before "an" insert -- which depict --

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 20,
Line 3, before "cutters" delete "gage"
Line 4, at the end of the line after "discussed" insert -- regarding --
Line 5, before "cutters" delete "gage" and delete the comma after "40B"
Line 7, change "capabilities, but instead" to -- capabilities. Instead --
Line 9, delete "are not mounted"
Line 10, delete directly on the radially outermost gage-facing surface, but"
Line 11, delete "instead"
Line 13, after "drill" and before "is" insert -- bit --
Line 14, change "view" to -- viewed -- and insert a comma after "Thus"
Line 17, delete the comma after "and"
Line 17, change "face portion" to -- lower face --
Line 19, change "cutters" to -- cutting elements --
Line 23, insert a comma after "40A"
Line 24, insert a comma after "10G"
Line 25, after "37" insert -- (gaps 37A, 37B shown in FIG. 21A) --
Line 26, change "surface" to -- surfaces --; change "pad" to -- pads --; and change "as" to -- and --
Line 34, after "back" and before "and" insert -- rakes --
Line 35, change "58" to -- 56 --
Line 37, change "centerline" to -- axis --
Line 42, after "gage" and before "cutters" insert -- pad --
Line 44, before "cutters" change "gage" to -- off-gage -- and delete "are and"
Line 45, delete "distant"
Line 46, change "most portion" to -- distant-most portions -- and change "40A and 40B" to -- 40A' and 40B' --
Line 48, change "30A, 30B" to -- 30A", 30B" --
Line 60, change "surfaces" to -- tables --

Column 21,
Line 3, delete the comma after "cutters"
Line 6, change "brick type" to -- brick-type --
Line 9, delete "cutters"
Line 11, change "FIGS." to -- figures --; insert a comma after "drawings"; and after "can" insert -- be --
Line 13, insert a comma after "21 C"
Lines 17, 20 and 48, change "hardfacing" to -- hard facing --
Line 18, change "35" to -- 35' -- and delete "FIG. 1 and"
Line 19, insert a comma after "However"

UNITED STATES PATENT AND TRADEMARK OFFICE

CERTIFICATE OF CORRECTION

PATENT NO. : 6,349,780 B1
DATED : February 26, 2002
INVENTOR(S) : Christopher C. Beuershausen It is certified that error appears in the above-identified patent and that said Letters Patent is hereby corrected as shown below:

Column 21,
Line 21, change "35" to -- 35' --
Line 22, change "and as is" to -- as --
Line 23, after "illustrated" and before "in" insert -- with respect to radial outermost facing surface of gage pads 30A', 30B' --; change "hardfacing" to -- hard facing --; and change "35" to -- 35' --
Line 32, after "compacts" insert -- 66B --
Line 33, delete "a"
Line 34, after "pad" insert -- /30A", -- change "pad" to -- pads --, change "is" to -- are --
Line 37, after "in" and before "flush-mounted" insert -- a --
Lines 39 and 53, change "hardfacing 35" to -- hard facing 35' --
Line 40, change "flush mounted" to -- 66B flush-mounted --
Line 42, change "larger diameter" to -- larger-diameter -- and after "in" delete "a"
Line 43, change "/30B"' to -- /30B" --
Line 46, insert a comma after "elements"
Line 51, insert a comma after "example"
Line 63, change "3" to -- 23 --
Lines 64, 65 and 67, after "of" delete "radius"

Column 22,
Line 1, before "under" delete "that"
Line 8, change "like" to -- likely --
Line 12, insert a comma after "which"
Line 14, insert a comma after "desirable"
Line 18, change "cutting" to -- bit body --
Line 22, change "over all" to -- overall --
Line 24, delete the comma after "herein"
Line 29, delete the comma after "extent"
Line 36, change "above detailed" to -- above-detailed --

UNITED STATES PATENT AND TRADEMARK OFFICE

CERTIFICATE OF CORRECTION

PATENT NO. : 6,349,780 B1 
DATED : February 26, 2002
INVENTOR(S) : Christopher C. Beuershausen It is certified that error appears in the above-identified patent and that said Letters Patent is hereby corrected as shown below:

Column 26,
Line 27, after "the" and before "circumferentially" insert -- plurality of --
Line 47, at the end of the line, after "of" insert -- the --
Line 56, change "33," to -- 35, --

Signed and Sealed this

Tenth Day of May, 2005

JON W. DUDAS
*Director of the United States Patent and Trademark Office*